US005525583A

United States Patent [19]

Aized et al.

[11] Patent Number: 5,525,583

[45] Date of Patent: Jun. 11, 1996

[54] SUPERCONDUCTING MAGNETIC COIL

[75] Inventors: Dawood Aized, Marlboro; Robert E. Schwall, Northborough, both of Mass.

[73] Assignee: American Superconductor Corporation, Westborough, Mass.

[21] Appl. No.: 192,724

[22] Filed: Feb. 7, 1994

Related U.S. Application Data

[62] Division of Ser. No. 186,328, Jan. 24, 1994, abandoned.

[51] Int. Cl.[6] ..... H01B 12/00; H01F 10/08

[52] U.S. Cl. ..... 505/211; 29/599; 29/605; 29/609; 335/216; 335/299; 336/DIG. 1; 505/705; 505/879; 505/880; 505/213

[58] Field of Search ..... 505/211, 213, 505/705, 879, 880; 29/599, 605, 609; 335/216, 299; 336/DIG. 1

[56] References Cited

U.S. PATENT DOCUMENTS 5,138,326 8/1992 Edwards et al. ..... 324/319

5,173,678 12/1992 Bellows et al. ..... 335/216

5,310,705 5/1994 Mitlitsky et al. ..... 505/211

OTHER PUBLICATIONS

Copy of International Search Report mailed Apr. 4, 1995.

*Primary Examiner* Joseph M. Gorski

*Attorney, Agent, or Firm* Fish & Richardson

[57] ABSTRACT

A superconducting magnetic coil includes a plurality of sections positioned axially along the longitudinal axis of the coil, each section being formed of an anisotropic high temperature superconductor material wound about a longitudinal axis of the coil and having an associated critical current value that is dependent on the orientation of the magnetic field of the coil. The cross section of the superconductor, or the type of superconductor material, at sections along the axial and radial axes of the coil are changed to provide an increased critical current at those regions where the magnetic field is oriented more perpendicularly to the conductor plane, to thereby increase the critical current at these regions and to maintain an overall higher critical current of the coil.

10 Claims, 12 Drawing Sheets

SUPERCONDUCTING MAGNETIC COIL

STATEMENT AS TO FEDERALLY SPONSORED RESEARCH

This invention arose in part out of research pursuant to Subcontract No. 86X-SK700V awarded by the Department of Energy.

BACKGROUND OF THE INVENTION

This is a continuation-in-part of Azied, entitled SUPERCONDUCTING MAGNETIC COIL, filed Jan. 24, 1994, Ser. No. 08/186,328 abandoned.

The invention relates to superconducting magnetic coils and methods for manufacturing them.

As is known in the art, the most spectacular property of a superconductor is the disappearance of its electrical resistance when it is cooled below a critical temperature $T_c$. Another important property is the destruction of superconductivity by the application of a magnetic field equal to or greater than a critical field $H_c$. The value of $H_c$, for a given superconductor, is a function of the temperature, given approximately by $$H_c = H_o(1 - T^2/T_c^2)$$

where $H_o$, the critical field at 0° K., is, in general, different for different superconductors. For applied magnetic fields less than $H_c$, the flux is excluded from the bulk of the superconducting sample, penetrating only to a small depth, known as the penetration depth, into the surface of the superconductor.

The existence of a critical field implies the existence of a critical transport electrical current, referred to more simply as the critical current ($I_c$) of the superconductor. The critical current is the current which establishes the point at which the material loses its superconductivity properties and reverts back to its normally conducting state.

Superconducting materials are generally classified as either low or high temperature superconductors operating below or at 4.2° K. and below or at 108° K., respectively. High temperature superconductors (HTS), such as those made from ceramic or metallic oxides are anisotropic, meaning that they generally conduct better in one direction than another. Moreover, it has been observed that, due to this anisotropic characteristic, the critical current varies as a function of the orientation of the magnetic field with respect to the crystallographic axes of the superconducting material. High temperature oxide superconductors include general Cu-O-based ceramic superconductors, members of the rare-earth-copper-oxide family (YBCO), the thallium-barium-calcium-copper-oxide family (TBCCO), the mercury-barium-calcium-copper-oxide family (HgBCCO), and BSCCO compounds containing stoichiometric amounts of lead (ie.,$(Bi,Pb)_2Sr_2Ca_2Cu_3O_{10}$).

High temperature superconductors may be used to fabricate superconducting magnetic coils such as solenoids, racetrack magnets, multipole magnets, etc., in which the superconductor is wound into the shape of a coil. When the temperature of the coil is sufficiently low that the conductor can exist in a superconducting state, the current carrying capacity as well as the magnitude of the magnetic field generated by the coil is significantly increased.

In fabricating such superconducting magnetic coils, the superconductor may be formed in the shape of a thin tape which allows the conductor to be bent around relatively small diameters and allows the winding density of the coil to be increased. The thin tape is fabricated as a multi-filament composite superconductor including individual superconducting filaments which extend the length of the multi-filament composite conductor and are surrounded by a matrix-forming material, which is typically silver or another noble metal. Although the matrix forming material conducts electricity, it is not superconducting. Together, the superconducting filaments and the matrix-forming material form the multi-filament composite conductor. In some applications, the superconducting filaments and the matrix-forming material are encased in an insulating layer. The ratio of superconducting material to matrix-forming material is known as the "fill factor" and is generally between 30 and 50%. When the anisotropic superconducting material is formed into a tape, the critical current is often lower when the orientation of an applied magnetic field is perpendicular to the wider surface of the tape, as opposed to when the field is parallel to this wider surface.

SUMMARY OF THE INVENTION

Controlling the geometry and/or type of anisotropic superconductor wound around a superconducting coil, increases an otherwise low critical current characteristic, associated with a region of the coil caused by the orientation of a magnetic field, thereby increasing the current carrying capacity and center magnetic field produced by the superconducting coil.

Generally, for a superconducting solenoid having a uniform distribution of high temperature superconductor wound along its axial length, the magnetic field lines emanating from the coil at its end regions become perpendicular with respect to the plane of the conductor (the conductor plane being parallel to the wide surface of the superconductor tape) causing the critical current density at these regions to drop significantly. In fact, the critical current reaches a minimum when the magnetic field is oriented perpendicularly with respect to the conductor plane. Although the critical current density is relatively high at the regions more central to the coil, the sharp decrease in the critical current density at the end regions provides an overall decrease in the current carrying capacity of the coil in its superconducting state.

Increasing the critical current value at the regions where the magnetic field is oriented more perpendicularly to the conductor plane can be provided in a number of ways. "Bundling" the amount of superconductor, by increasing the number of strands of the superconductor connected in parallel provides a greater cross section, thereby increasing the critical current at low $I_c$ regions. With this arrangement, the same type of superconductor, usually from the same superconductor tape manufacturing run, is used for the different sections of the coil. Varying the bundling of superconductor can be accomplished along the axis of the superconducting coil, for example, from one pancake section to the next, as well as within the pancake itself where the conductor cross-sectional area changes radially from the inner part to the outer part of the coil.

On the other hand, different superconductors having different fill factors may be used to distribute the amount of superconductor to control the critical current at the different sections of the coil. In still another arrangement, altogether different high temperature superconductors having different $I_c$ characteristics may be used for the different sections of the coil.

Because the magnetic field associated with a superconducting coil is directly related to the current carrying capacity of the coil, a concomitant increase in the magnetic field provided by the coil is also achieved. Even in applications where the volume of superconductor used for the coil is desired to be maintained substantially constant, and bundling of the superconductor requires that the number of turns associated with that section of the coil be reduced, the decrease in magnetic field at the regions of the coil associated with such sections does not significantly effect the magnitude of the magnetic field at the center region of the coil. Adjusting the geometry of the sections of the coil also provides, to some extent, a desired field distribution profile, while maintaining a higher critical current density of the coil.

Moreover, other problems commonly encountered with multi-sectioned uniform current density superconducting coils can be alleviated. For example, each section of a multi-sectioned uniform current density superconducting coil has an associated critical current value dependent on the orientation of the field incident on that section at any given time. In a uniform current density coil, where all of the sections are uniformly wound with the same amount of superconductor, certain sections (generally those at the end regions of the coil) will have critical current values significantly less than those positioned at the center of the coil. Unless the superconducting coil is operated at a critical current less than the lowest critical current value of the sections, the section with the lowest $I_c$ will operate in its normal non-superconducting state. In some situations, flawed sections of the superconductor, for example, during its manufacture, will have an $I_c$ value significantly lower than other sections of the superconductor. Current passing through a normally conducting section, generates $I^2R$ losses in the form of heat which propagates along the length of the superconductor to adjacent sections. Due to the heat generated in the normally conductive section, adjacent sections begin to warm causing them to become non-superconducting. This phenomena, known as "normal-zone propagation" causes the superconducting characteristic of these sections to degrade which leads to the loss of superconductivity for the entire coil, referred to as a "quench".

Because the critical current values associated with each of the individual sections (measured with respect to the orientation of the field incident on that section) of a graded superconducting coil, in accordance with the invention, have $I_c$ values closer to each other, the coil can be operated at a higher overall critical current. An additional advantage of maintaining a small difference between the critical current values of the individual sections of the superconducting coil is that a relatively quick transition to the overall critical current of the coil is obtained. Thus in the event that the coil reverts from the superconducting state to a normal state (quenches), the inductive energy stored in the coil is distributed uniformly throughout the coil rather than being localized where it might cause damage due to heating.

In one aspect of the invention, a magnetic coil features a plurality of sections positioned axially along a longitudinal axis of the coil, each section including a high temperature superconductor wound about the longitudinal axis of the coil, and having regions with critical current values, measured at a zero magnetic field, which increase in value from a central portion of the coil to end portions of the coil.

Particular embodiments of the invention include one or more of the following features. The critical current value of each section is dependent on the angular orientation of the magnetic field of the coil and is selected to provide a desired magnetic field profile for the coil. The critical current value of each section can be selected by varying the cross-sectional area of the superconductor of at least one section or by changing the type of superconductor of at least one section. The superconductor may be a mono-filament or a multi-filament composite superconductor including individual superconducting filaments which extend the length of the multi-filament composite conductor and are surrounded by a matrix-forming material. The number of individual superconducting filaments associated with a first one of the plurality of sections may be different than the number of individual superconducting filaments associated with a second one of the plurality of sections. The cross-sectional area of the superconductor is varied in a direction parallel to the longitudinal axis of the coil. and increases for the sections positioned at the central portion of the coil to the sections positioned at the end portions of the coil. The cross-sectional area of the superconductor is varied in a direction transverse to the longitudinal axis of the coil and decreases from regions proximate to the inner radial portion of the coil to the outer radial portion of the coil. The orientation of the individual tape-shaped superconducting filaments is other than parallel with respect to a conductor plane defined by a broad surface of the tape. The sections of the superconductor are formed of pancake or double pancake coils and the cross-sectional area of the superconductor is varied by increasing the number of strands of superconductor connected in parallel. The high temperature superconductor comprises $Bi_2Sr_2Ca_2Cu_3O$.

In another aspect of the invention, a superconducting magnetic coil features sections, positioned axially along a longitudinal axis of the coil, including a high temperature superconductor wound about the longitudinal axis of the coil, and each section having regions with critical current being substantially equal when a preselected operating current is provided through the superconducting coil.

In another aspect of the invention, a method for providing a superconducting magnetic coil including a plurality of sections positioned axially along the axis, with each section being formed of a preselected high temperature superconductor material wound about a longitudinal axis of the coil and having an associated critical current value, and each section contributing to the overall magnetic field of the coil, features the following steps:

a) positioning the sections along the axis of the coil to provide a substantially uniform distribution of superconductor material along the axis of the coil;

b) determining critical current data for each of the sections on the basis of the superconductor material associated with each section and the magnitude and angle of a magnetic field;

c) determining a distribution of magnetic field magnitude and direction values for a set of spaced-apart points within the magnetic coil;

d) determining critical current values for each of the points within the coil based on the distribution of magnetic field magnitude and direction values and the critical current data;

e) determining contributions toward the overall magnetic field of the coil from each of the sections;

f) determining a critical current value for the coil and for each section positioned along the axis of the coil; and g) changing the critical current value of at least one section of the coil to provide critical current values for each section substantially equivalent to each other.

In preferred embodiments, the method features one or more of the following additional steps. Steps c) through g)

are repeated until the critical current values of each of the sections based on the distribution are within a desired range of each other. The step of changing the critical current value of at least one section of the coil includes changing the type of superconductor or increasing the cross-sectional area of the superconductor material associated with sections of the superconductor that are axially or radially distant from the center of the coil for at least one section of the coil. The step of determining a critical current value for each section positioned along the axis of the coil includes the step of determining an average critical current value for each section, the average critical current value based on values of critical current associated with points extending either axially away or radially away from the center. The step of changing the critical current value of at least one section of the coil includes increasing the cross section of the superconductor material associated with sections of the superconductor that are away from the center of the coil. The step of determining critical current data for each of the sections of the coil further features the steps of measuring the critical current of the superconductor material associated with each section at a number of different magnitudes and angles of an applied background magnetic field, and extrapolating critical current data for unmeasured magnitudes and angles of a background magnetic field.

With this method, a superconducting coil having a predetermined volume of superconductor may have sections in which their geometries (for example, cross-sectional area) are changed along both the longitudinal and radial axes of the superconducting coil, thereby increasing the current carrying capacity and center magnetic field without increasing the volume of superconductor in the coil.

Other advantages and features will become apparent from the following description and the claims.

DESCRIPTION OF THE PREFERRED EMBODIMENT

Figure 1:
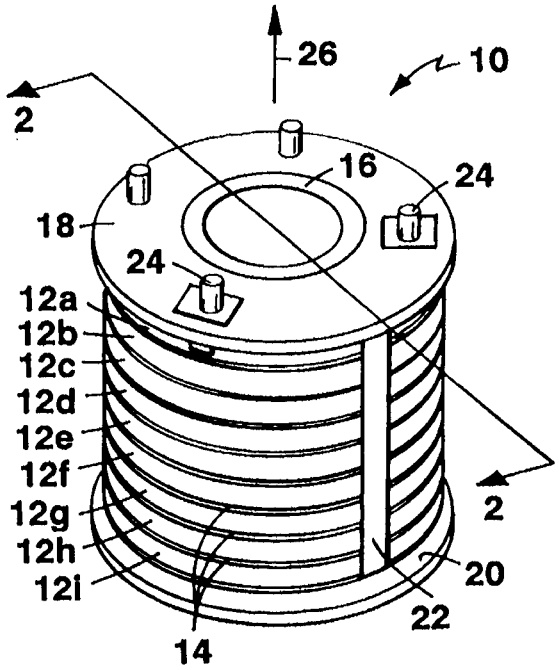
FIG. 1 is a perspective view of a multiply stacked superconducting coil having "pancake" coils.
Figure 2:
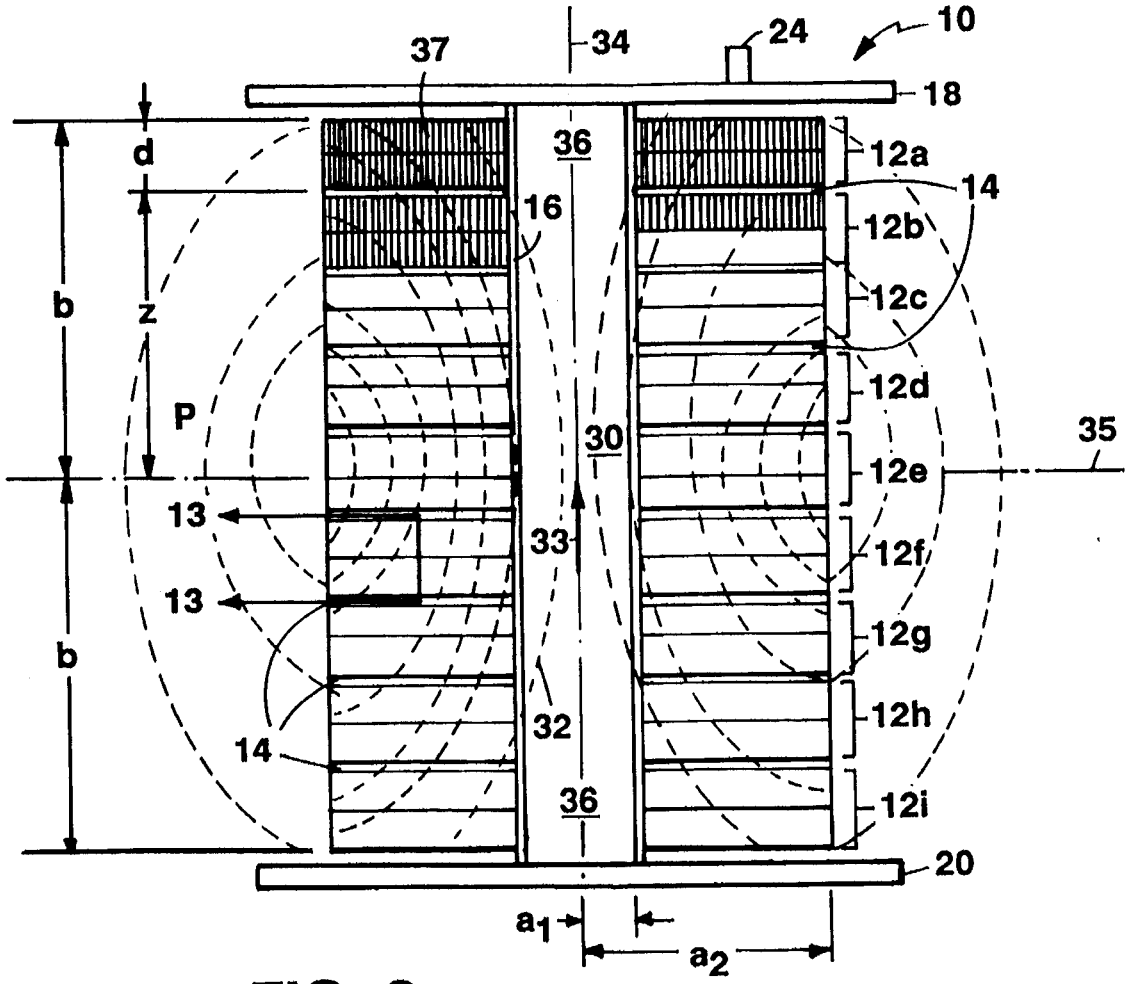
FIG. 2 is a cross-sectional view of FIG. 1 taken along line 2—2.

Referring to FIGS. 1–2, a mechanically robust, high-performance superconducting coil assembly 10 combines multiple double "pancake" coils **12*a*–12*i*, here nine separate pancake sections, each having co-wound composite conductors. The illustrated conductor is a high temperature metal oxide ceramic superconducting material known as $Bi_2Sr_2Ca_2Cu_3O$, commonly designated BSCCO (2223). In the coil assembly 10, each double "pancake" coil 12*a*–12*i* has co-wound conductors wound in parallel which are then stacked coaxially on top of each other, with adjacent coils separated by a layer of plastic insulation 14**.

Pancake coils **12*a*–12*i* are formed by continuously wrapping the superconducting tape over itself, like tape on a tape recorder spool. An insulating tape of thin polyester film, sometimes with an adhesive, can be wound between the turns. Alternatively, the conductor can incorporate a film or oxide insulation applied before winding. Note that the superconductor may be completely processed to its final state prior to winding ("react and wind" coil) or may be exposed to a degree of heat treatment after the pancakes have been wound ("wind and react" coil), the method influencing the insulation system chosen. In one embodiment, the completed pancakes are then stacked and connected in series by bridging pieces of conductive tape soldered between stacks. Plastic insulation 14, formed as disc-shaped spacers are suitably perforated to permit the free circulation of refrigerant and are usually inserted between the pancakes during stacking. Pancake coils 12*a*–12*i*** here are constructed as "double-pancake" coils with the tape appearing to be wound from the outside to the inside of the first pancake and then wound from the inside to the outside of the second pancake, thereby eliminating the soldered bridge between the two pancakes which would otherwise occur at the inner diameter of the coil.

An inner support tube 16 fabricated from a plastic-like material supports the coils **12*a*–12*i*. A first end flange 18 is attached to the top of inner support tube 16, with a second end flange 20 threaded onto the opposite end of the inner support tube in order to compress the double "pancake" coils. In an alternate embodiment, inner support tube 16 and end flanges 18, 20** can be removed to form a free-standing coil assembly.

Electrical connections consisting of short lengths of superconducting material (not shown) are made to join the individual coils together in a series circuit. A length of superconducting material 22 also connects one end of coil 10 to one of the termination posts 24 located on end flange 18 in order to supply current to coil assembly 10. The current is assumed to flow in a counter-clockwise direction, and the magnetic field vector 26 is generally normal to end flange 18 forming the top of coil assembly 10.

Referring to FIG. 2, the superconducting magnetic coil 10, has a magnetic field characteristic similar to a conventional solenoid in which the magnetic field intensity at points outside the coil (for example, point P) is generally less than at points internal to the coil. For conventional magnetic coils, the current carrying capacity is substantially constant throughout the windings of the conductor. On the other hand, with low temperature superconductors, the critical current is dependent only on the magnitude of the magnetic field and not its direction.

Further, as discussed above, the current carrying capacity of a high temperature superconductor is not only a function of the magnitude but the angular orientation of the magnitude field. In a central region 30 of the coil, the magnetic field lines 32 are generally parallel (indicated by an arrow 33) with the longitudinal axis 34 of the coil and become less so as the magnetic field lines extend away from a central region 30 and towards end regions 36 of coil 10. Indeed, the orientation of field lines 32 at end regions 36 (indicated by an arrow 37) become substantially perpendicular with respect to axis 34.

Figure 3:
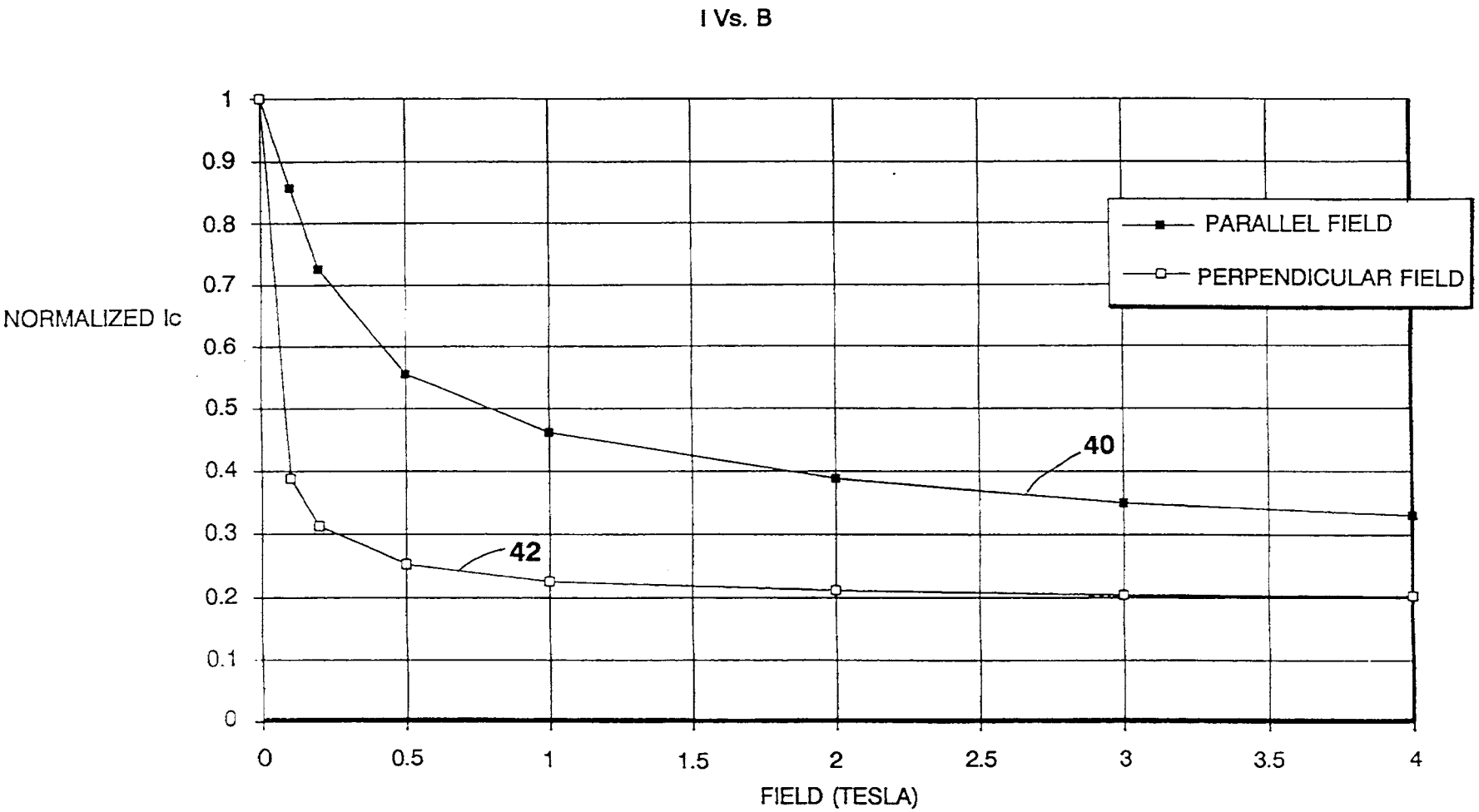
FIG. 3 is a graph showing normalized critical current as a function of magnetic field in units of Tesla.

Referring to FIG. 3, the anisotropic characteristic of critical current as a function of magnetic field for BSCCO (2223) high temperature superconductor is shown for applied magnetic fields oriented parallel (line 40) and perpendicularly (line 42) to the conductor plane. The actual critical current values have been normalized to the value of critical current of the superconductor measured at a zero magnetic field. Normalized critical current is often referred to as the critical current retention. As shown in FIG. 3, the normalized critical current, at a magnetic field of 2.0 T (tesla), drops significantly from about 0.38 for a parallel oriented magnetic field to 0.22 for a perpendicularly oriented magnetic field.

In addition to being dependent on the magnitude and orientation of the magnetic field, the critical current of a high temperature superconductor varies with the particular type of superconductor as well as its cross-sectional area. Thus, in order to compensate for the drop in critical current of the superconductor at end regions 36 of coil 10 due to the magnetic field becoming more perpendicular with respect to the conductor plane, those pancakes positioned at the end regions (for example, 12*a*, 12*b*, 12*g*, 12*h*) may be fabricated with a superconductor having a higher critical current characteristic, or alternatively, may be formed to have a greater cross-sectional area of superconductor relative to those regions more central to the coil.

Figure 4:
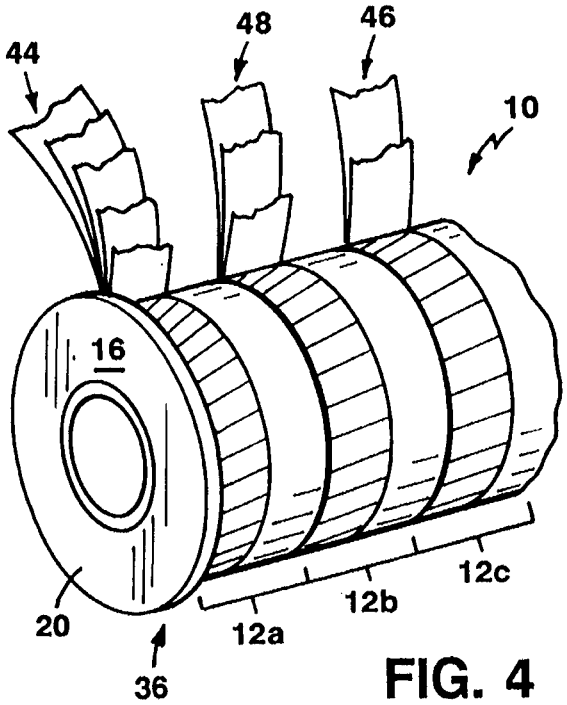
FIG. 4 is a view of the coil showing the conductors partially peeled-away.
Figure 14:
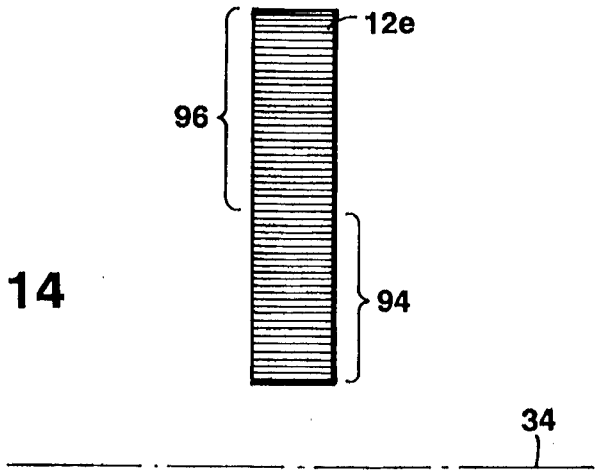
FIG. 14 is a cross-sectional view of an exemplary one of the pancakes of FIGS. 1 and 2.

For example, referring to FIG. 4, a graded superconducting coil assembly 10 is shown with one side of the three endmost double pancakes 12*a*, 12*b*, and 12*c*, peeled away to show that an increased amount of superconductor tape is used for the double pancakes positioned axially furthest from the central region 30 of the coil. In particular, pancake 12*a* includes five wraps of conductor tape 44 between wraps of insulating tape as compared to only two wraps of conductor tape 46 for pancake 12*c* located more closely to the center region 30. Pancake 12*b*, positioned between pancakes 12*a* and 12*c*, includes three wraps of conductor tape 48 to provide a gradual increase of superconductor to compensate for the gradual decrease in the critical current, due to the generated magnetic field, when moving from pancake 12*c* to pancake 12*a*. As will be discussed below, in conjunction with FIGS. 13 and 14, the cross-sectional area of superconductor can be varied along the radial axis of the coil during its fabrication.

Figure 5:
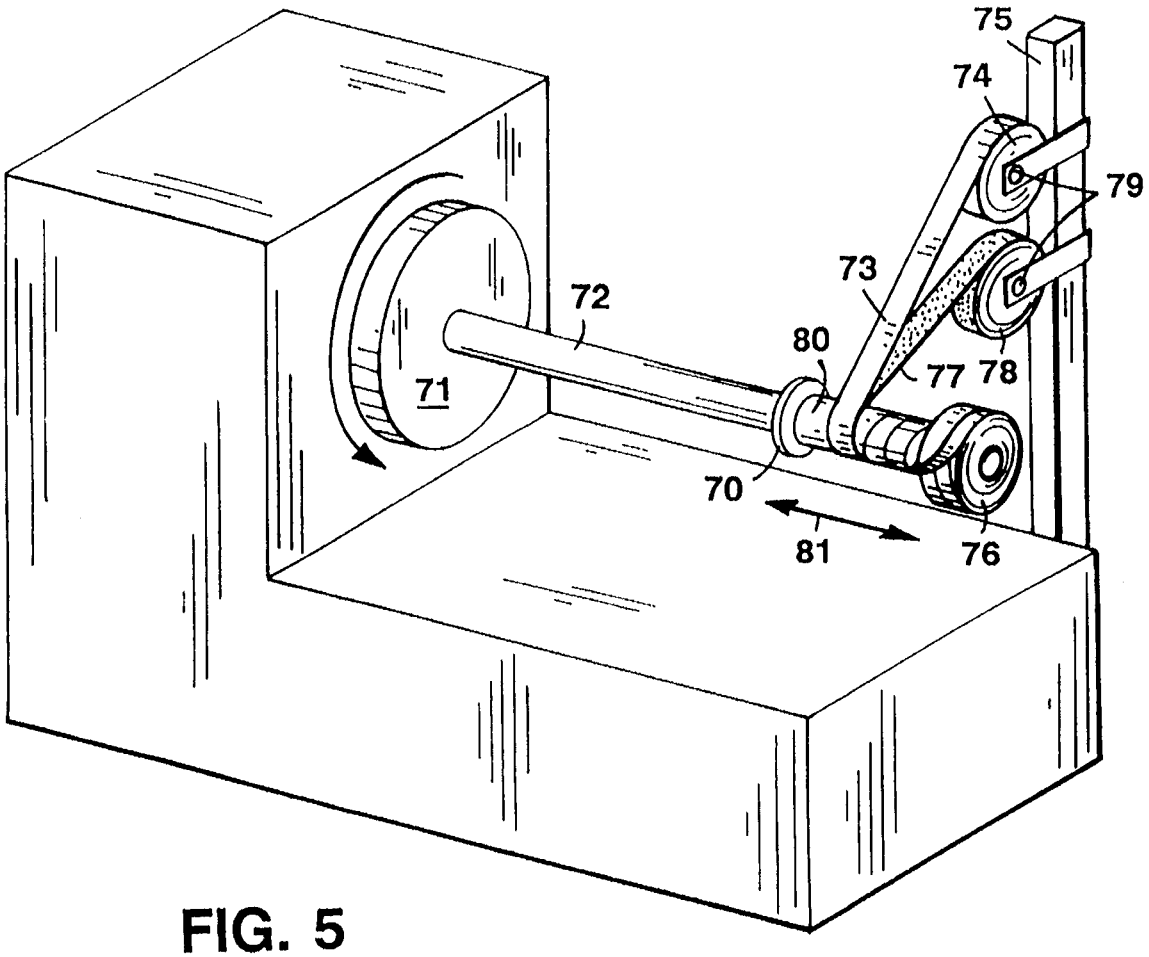
FIG. 5 illustrates a coil-winding device.

Referring to FIG. 5, in one approach for fabricating a superconducting coil, a mandrel 70 is held in place by a winding flange 72 mounted in a lathe chuck 71, which can be rotated at various angular speeds by a device such as a lathe or rotary motor. The multi-filament composite conductor is formed in the shape of a tape 73 and is initially wrapped around a conductor spool 74. In a react-and-wind process for fabricating a superconducting coil, the conductor is a precursor material which is fabricated and placed in a linear geometry, or wrapped loosely around a coil, and placed in a furnace for processing. The precursor is then placed in an oxidizing environment during processing, which is necessary for conversion to the superconducting state. In the react-and-wind processing method, insulation can be applied after the composite conductor is processed, and material issues such as the oxygen permeability and thermal decomposition of the insulating layer do not need to be addressed. On the other hand, in a wind-and-react processing method, the precursor to the superconducting material is wound around a mandrel in order to form a coil, and then processed with high temperatures and an oxidizing environment. Details related to the fabrication of superconducting coils are discussed in co-pending application Ser. No. 08/188,220 filed on Jan. 28, 1994 filed by M. D. Manlief, G. N. Riley, Jr., J. Voccio, and A. J. Rodenbush, entitled "Superconducting Composite Wind-and-React Coils and Methods of Manufacture", assigned to the assignee of the present invention, and attached herewith as Appendix I.

In the wind-and-react processing method, a cloth 77 comprising an insulating material is wrapped around an insulation spool 78, both of which are mounted on an arm 75. The tension of the tape 73 and the cloth 77 are set by adjusting the tension brakes 79 to the desired settings. A typical value for the tensional force is between 1–5 lbs., although the amount can be adjusted for coils requiring different winding densities. The coil forming procedure is accomplished by guiding the eventual conducting and insulating materials onto the rotating material forming the central axis of the coil. Additional storage spools 76 are also mounted on the winding shaft 72 in order to store portions of the tape 73 intended to be wound after the initial portions of materials stored on spool 74 on the arm 75 have been wound onto the mandrel.

In order to form a coil 80, the mandrel 70 is placed on the winding shaft 72 next to storage spools 76 and the devices are rotated in a clockwise or counter-clockwise direction by the lathe chuck 71. In certain preferred embodiments of the invention, a "pancake" coil is formed by co-winding layers of the tape 73 and the cloth 77 onto the rotating mandrel 70. Subsequent layers of the tape 73 and cloth 77 are then co-wound directly on top of the preceding layers, forming a "pancake" coil having a height 81 equal the width of the tape 73. The "pancake" coil allows both edges of the entire length of tape to be exposed to the oxidizing environment during the heat treating step.

In other preferred embodiments of the invention, a double "pancake" coil may be formed by first mounting the mandrel 70 on the winding shaft 72 which is mounted in lathe chuck 71. A storage spool 76 is mounted on the winding shaft 72, and half of the total length of the tape 73 initially wrapped around spool 74 is wound onto the storage spool 76, resulting in the length of tape 73 being shared between the two spools. The spool 74 mounted to the arm 75 contains the first half of the length of tape 73, and the storage spool 76 containing the second half of the tape 73 is secured so that it does not rotate relative to mandrel 70. The cloth 77 wound on the insulation spool 78 is then mounted on the arm 75. The mandrel is then rotated, and the cloth 77 is co-wound onto the mandrel 70 with the first half of the tape 73 to form a single "pancake" coil. Thermocouple wire is wrapped around the first "pancake" coil in order to secure it to the mandrel. The winding shaft 72 is then removed from the lathe chuck 71, and the storage spool 76 containing the second half of the length of tape 73 is mounted on arm 75. A layer of insulating material is then placed against the first "pancake" coil, and the second half of the tape 73 and the cloth 77 are then co-wound on the mandrel 70 using the process described above. This results in the formation of a second "pancake" coil adjacent to the "pancake" coil formed initially, with a layer of insulating material separating the two coils. Thermocouple wire is then wrapped around the second "pancake" coil to support the coil structure during the final heat treatment. Voltage taps and thermo-couple wire can be attached at various points on the tape 73 of the double "pancake" coil in order to monitor the temperature and electrical behavior of the coil. In addition, all coils can be impregnated with epoxy after heat treating in order to improve insulation properties and hold the various layers firmly in place. The double "pancake" coil allows one edge of the entire length of tape to be exposed directly to the oxidizing environment during the final heat treating step.

Figure 6:
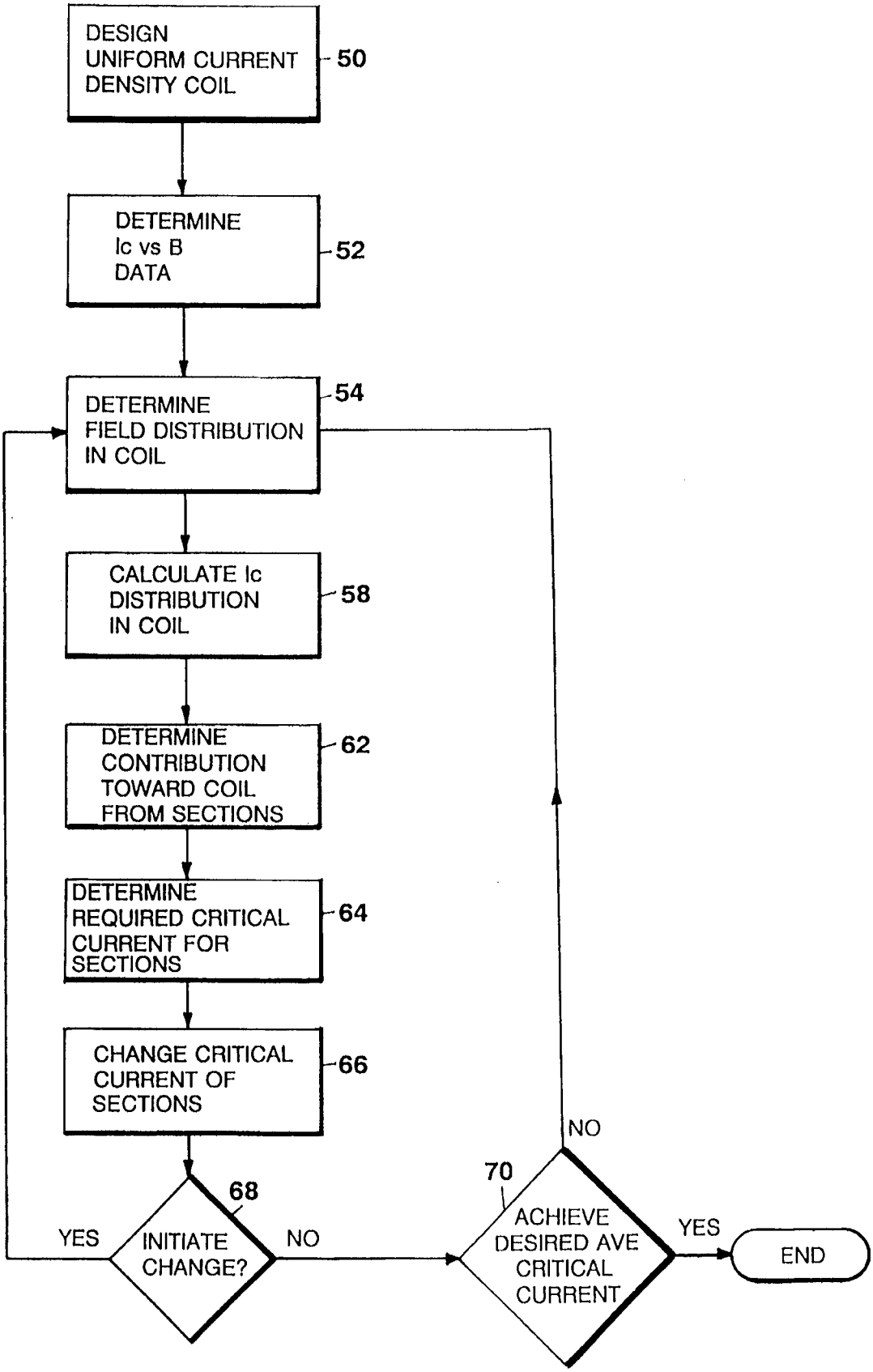
FIG. 6 is a flow diagram describing the method of making the superconducting coil of the invention.

An explanation of a method for providing a graded superconducting coil follows in conjunction with FIG. 6. A graded superconducting magnetic coil similar to the one shown in FIGS. 1 and 2 and having the characteristics shown below in Table I, is used to illustrate the method.

TABLE I

| | |
|---|---|
| Winding inner diameter (ID) :: | 1.00 inch |
| Winding outer diameter (OD) :: | 3.50 inches |
| Coil length (L) :: | 4.05 inches |
| Number of double pancakes :: | 9 |
| Number of turns/double pancake :: | 180 |
| Conductor tape width = | .210 inches |
| Conductor tape thickness :: | .006 inches |
| Critical current of the wire :: | 82 A (4.2° K. at 0 Tesla) |
| Target center field :: | 1 Tesla |

Referring to FIG. 6, in accordance with a particular embodiment of the invention, a first step 50 in designing a graded superconducting coil is the design of a uniform current density (non-graded) coil in which the conductor is evenly distributed along the axial length of the coil. The design of such a coil can be determined as described, for example, in D. Bruce Montgomery, *Solenoid Magnet Design*, pp 1–14 (Robert E. Krieger Publishing Company 1969), which is hereby incorporated by reference. Taking into account certain geometrical constraints (for example, the size of the cryostat for providing the low temperature environment), current densities of the selected high temperature superconductor and the desired magnetic field required from the coil, the following relationship can be used to determine the required geometry of the coil:

$$j = \frac{H_{cen}}{a_1 \lambda F(\alpha,\beta)} \quad (1)$$

where:

$H_{cen}$ is the field at the center of the coil;

$\lambda$ (the winding density of the coil) equals the active section of the winding divided by the total winding section; and F is a geometric constant defined as:

$$F = \frac{4\pi\beta}{10}\left(\mathrm{Sinh}^{-1}\frac{\alpha}{\beta} - \mathrm{Sinh}^{-1}\frac{1}{\beta}\right). \quad (2)$$

where $$\alpha = \frac{a_2}{a_1} \text{ and } \beta = \frac{b}{a_1}$$

where $a_1$ and $a_2$ are the inner and outer radii of the coil and b is half of the total axial length of the coil (see FIG. 2).

To determine the critical current of the coil and its sections, it is necessary to know the critical current characteristic of the particular high temperature superconductor(s) used in the coil. This information (step 52) is often provided not only for the particular superconductor material, but because of changes in the manufacturing process, is generally provided for each manufacturing run of the superconductor. In one approach for providing $I_c$ as a function of magnetic field (B), as shown in FIG. 3, a current is applied to a length of the superconductor at a desired operating temperature, here 4.2° K., while monitoring the voltage across the length of superconductor. The current is increased until the superconductor resistivity approaches a certain value, thereby providing the critical current value at that field. The method of determining critical current for superconductors is described in D. Aized et al, *Comparing the Accuracy of Critical-Current Measurements Using the Voltage-Current Simulator*, Magnet Technology Conference (MT-13), to be published, and attached herewith as Appendix II. An external magnet is used to provide a background magnetic field to the superconductor at various magnetic field intensities and orientations. FIG. 3, as discussed above, shows measured values of the critical current as a function of this applied magnetic field for a background magnetic field oriented both parallel and perpendicular to the conductor plane.

Although it is desirable to characterize each superconductor at as many different field intensities and angles of orientation as possible, it is appreciated that such data collection can be voluminous and time consuming, and thus extrapolation methods can be used to expand data measured at a limited number of points. Thus, where measured data at different angles is not available, data measured with the magnetic field applied parallel and perpendicular to the conductor plane can be used with approximation models to generate critical current values for fields applied at different angles.

In one approximation model, called the minimum retention model, the critical current of the conductor is determined for both parallel and perpendicular field components with the lower value of critical current taken as the critical current at the point under consideration.

In another approximation model, called the gaussian distribution model, the effect of the orientation of individual filaments of superconductor with respect to the plane of the tape (that is, the conductor plane) is considered. When the superconductor is formed as a multi-filament composite superconductor, as discussed above, the superconducting filaments and the matrix-forming material are encased in an insulating ceramic layer to form the multi-filament composite conductor. Although the individual filaments are generally parallel to the plane of the composite conductor tape, some of the filaments may be offset from parallel and therefore have a perpendicular field component associated with them. The gaussian distribution model assumes that the orientation of the individual superconducting filaments with respect to the conductor plane follow a Gaussian distribution. The characteristic variance is varied to match the critical current data measured in step 52 and once the variance is found, it can be used to determine the critical current at any given field and angle.

In still another model, called the superimposing model, a normalized critical current is determined for both the perpendicular and parallel components of the magnetic field and then the product taken of the two values.

Curve-fitting based on the measured data can be advantageously used to derive a polynomial expression which provides a critical current value for any magnetic field intensity and orientation angle. The following polynomial expression having the constants as shown in Table II was used to generate the curves shown in FIG. 3:

$$I_c(B)=1/(a_0+a_1B+a_2B^2+a_3B^3+a_4B^4+a_5B^5+a_6B^6)$$

TABLE II

| Constants | Parallel Field Data | Perpendicular Field Data |
|---|---|---|
| $a_0$ | 0.995 | 1.032 |
| $a_1$ | 1.650 | 18.550 |
| $a_2$ | 1.096 | −45.140 |
| $a_3$ | −3.335 | 51.967 |
| $a_4$ | 2.344 | −28.481 |
| $a_5$ | −0.659 | 7.817 |
| $a_6$ | 0.0649 | −0.669 |

Results from the minimum retention and gaussian distribution models were generally found to be similar and provided a better match to the measured data than the superimposing model with the minimum retention model preferred due to its ease of implementation.

Once a database of critical current as a function of magnetic field has been obtained for each superconductor material to be used in the graded superconducting coil, the magnetic field distribution for a predetermined number of points (for example, 1000 points) within the coil is determined (step 54). The field calculations for determining the field distribution within the coil is dependent on the geometry of the coil (for example, inner and outer diameter, length of coil), the characteristics of the superconductor (for example, conductor width and thickness for tape, conductor radius for wire), as well as, the insulation thickness, and relative position of individual sections of the coil. A software program called MAG, (an in-house program used at American Superconductor Corporation, Westboro, Mass.), provided the total magnetic field, as well as the radial and axial components, as a function of radial and axial position within the superconducting coil. Table III shows a small representative portion of the output data provided by MAG for the coil having the geometry and characteristics described above.

TABLE III

| Position | Radial Position | Axial Position | Component of Field $B_r$ (Rad) | $B_a$ (Axi) | B (tot) |
|---|---|---|---|---|---|
| 1 | 0 | 0 | 4.82E-16 | 1.73E-02 | 1.73E-02 |
| 2 | 0 | 0.12 | −9.70E-17 | 1.73E-02 | 1.73E-02 |
| 3 | 0 | 0.24 | 2.24E-16 | 1.73E-02 | 1.73E-02 |
| 4 | 0 | 0.36 | 1.26E-16 | 1.73E-02 | 1.73E-02 |
| 5 | 0 | 0.48 | 2.55E-16 | 1.73E-02 | 1.73E-02 |
| . | . | . | . | . | . |
| . | . | . | . | . | . |
| . | . | . | . | . | . |
| 14 | 0 | 1.56 | −7.80E-17 | 1.68E-02 | 1.68E-02 |
| 15 | 0 | 1.68 | 1.16E-15 | 1.68E-02 | 1.68E-02 |
| 16 | 0 | 1.80 | 9.69E-16 | 1.67E-02 | 1.67E-02 |
| 17 | 0 | 1.92 | −8.95E-16 | 1.66E-02 | 1.66E-02 |

Commercially available software, such as ANSYS, a product of Swanson Analysis Systems Inc., Houston, PA, or COSMOS, a product of Structural Research and Analysis Group, Santa Monica, Calif., may also be used to generate the field distribution information.

Figure 7:
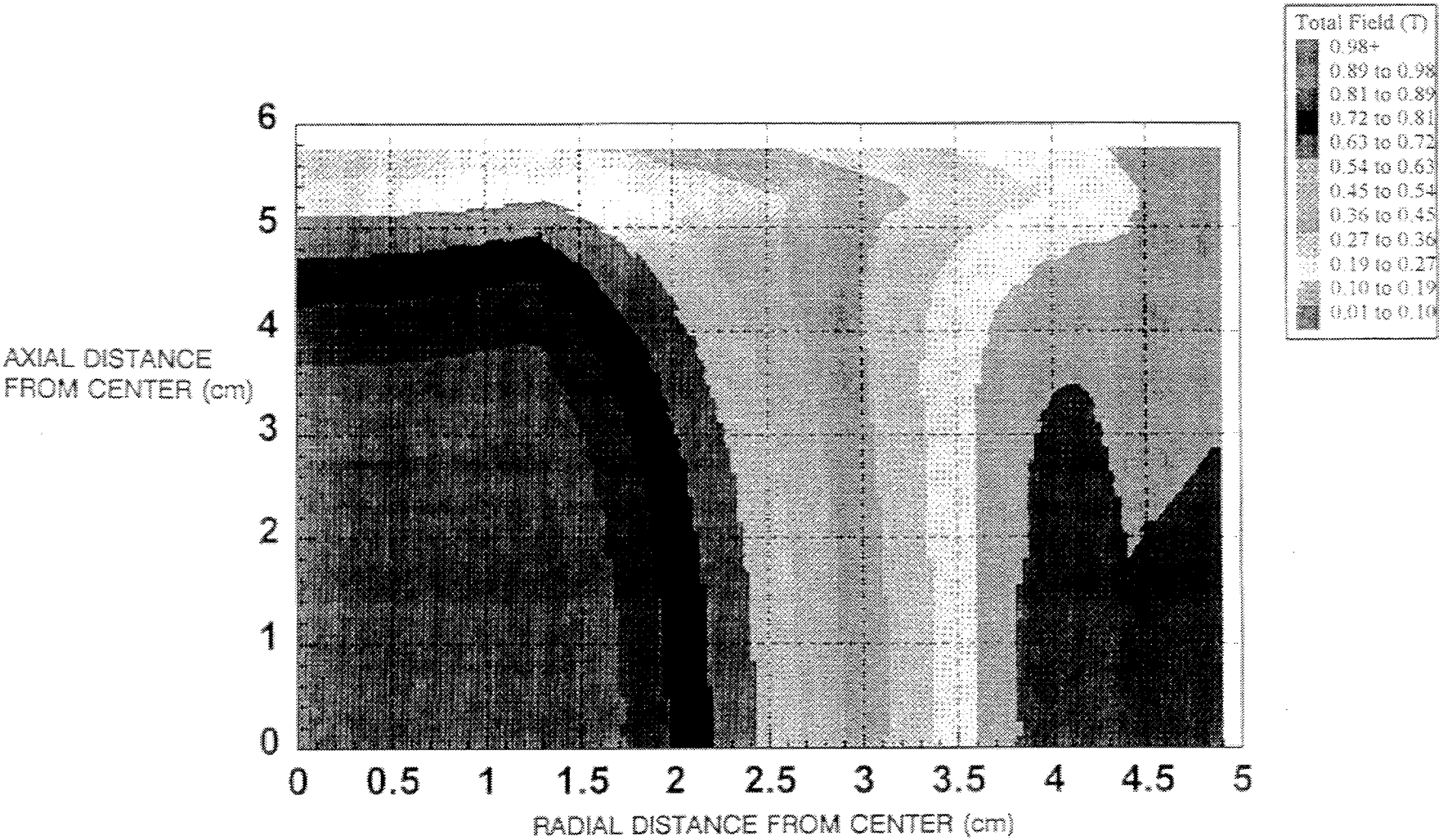
FIG. 7 is a plot showing the total magnetic field distribution within a superconducting coil having a uniform current distribution.
Figure 8:
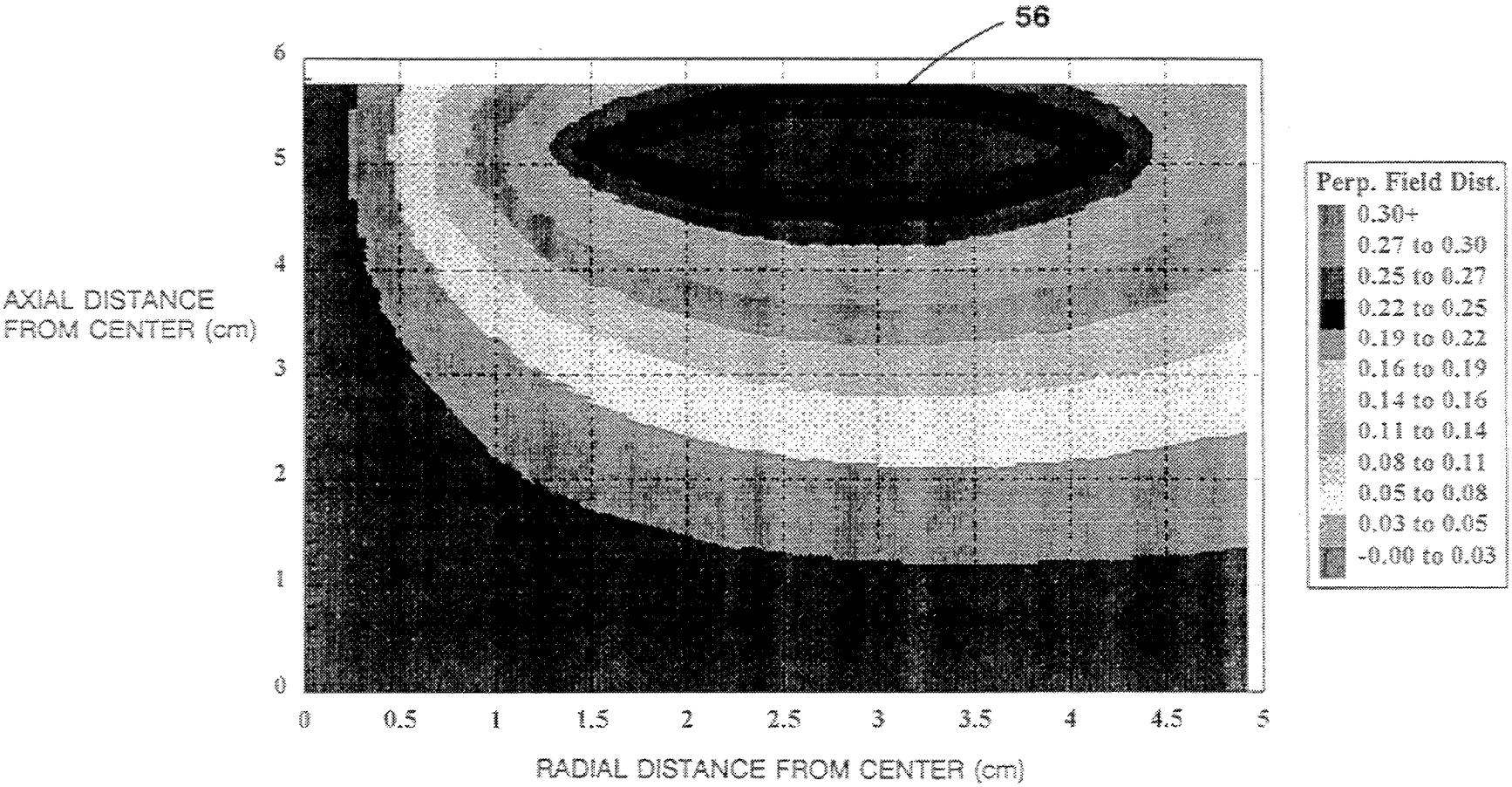
FIG. 8 is a plot showing the distribution of a magnetic field oriented perpendicularly to the conductor plane within the uniform current density superconducting coil.

Referring to FIG. 7, the total field distribution data for the coil defined in Table I is shown plotted in graphical form using any number of commercially available software programs, such as Stanford Graphics, a product of 3-D Visions, Torrance, Calif. In addition, as shown in FIG. 8, the magnetic field for the same coil when the field is oriented perpendicularly to the conductor plane is maximum at point 56, near the end regions of the coil (about 5.2 cm from the center along the longitudinal axis of the coil) and a little more than half of the radial distance to the outer diameter of the coil (about 2.7 cm).

The field distribution data generated in step 54 provides a magnetic field value at each of the predetermined number of points within the coil which can be used in conjunction with the $I_c$ versus B data provided in step 52 to derive a critical current distribution within the coil (step 58). In other words, the magnetic field values from the field distribution data are used in the polynomial expression described above to determine critical current values for each point. In particular, critical current values are determined for both the parallel field and perpendicular field orientations with the minimum value used to represent the critical current value for that point. The $I_c$ distribution data is shown plotted in FIG. 9 and indicates that, consistent with the field distribution data of FIG. 8, the minimum critical current retention values (that is, normalized critical current) is found in shaded region 60 at end regions of the coil.

The next step of the method involves determining the contributions of each of the sections of coil 10, that is pancakes 12*a*–12*i*, toward the center magnetic field of the coil step 62. Contributions from each pancake 12*a*–12*i* are determined using the relationships described above in conjunction with determining the field distribution of the uniform density coil (step 54). To determine each contribution, the coil is assumed to be symmetrical about the mid-plane through axis 35 (FIG. 2) with pancakes on either side of midplane 35 being symmetrically paired (for example, 12*a* and 12*i*, 12*b* and 12*h*, 12*c* and 12*g*, etc.). The contribution of each pair of sections is then determined, using the field relationships described above, by 1) determining or evaluating the total field generated by a coil having a length defined by the outermost length of the paired sections of interest, 2) determining or evaluating the total field generated by a coil having a length defined by the innermost length of the paired sections of interest, and then 3) subtracting the results of the two determinations or evaluations. Each of the paired sections can then be divided by one-half to determine the contribution for each pancake of the pair of sections. For example, referring to FIG. 2 again, to determine the contribution of paired pancakes 12*a* and 12*i*, the field determined for a coil having length 2*z* is subtracted from the field of a coil having length 2*b*. The contribution toward the center field from each of pancakes 12*a* and 12*i* is then one-half of the contribution of the symmetric pair. Similarly, to determine the contribution of pancakes 12*b* and 12*h*, the field determined for a coil having length 2(*b*–*d*) or 2*z* is subtracted from a coil having a length 2(*b*–2*d*). [Note that the inner and outer radii $a_1$ and $a_2$ are the same for all calculations.] The total field generated by the whole assembly of the coil is the sum of all the contributions from the different pancakes.

The $I_c$ distribution data generated in step 58 is then used to optimize the distribution of superconductor for different regions of the coil. For a superconducting coil in which double pancake coils 12a–12i are used (like the one shown in FIGS. 1 and 2) each position corresponds with an associated one of the individual pancakes and the $I_c$ value for positions along the longitudinal axis of the coil is determined (step 64).

In one approach, called the critical current averaging approach, a weighted average of all $I_c$ values extending radially within the region for each axial position or pancake, is determined using the following relationship:

$$I_c\,\mathrm{Ave}(z) = \frac{(\Sigma I_c\, x\ \mathrm{radius})}{(\Sigma \mathrm{radii})}.$$

Thus, for a given axial position of the coil, the average of all the critical current values corresponding to that axial position in that region is provided with the radius of each point being the averaging weight for that point. In addition, the average critical current value for each radial position in the region associated with each section, with equal weight given for each point, is determined using the following relationship:

$$I_c\,\mathrm{Ave}(r) = \Sigma I_c/(\text{number of points}).$$

Figure 10:
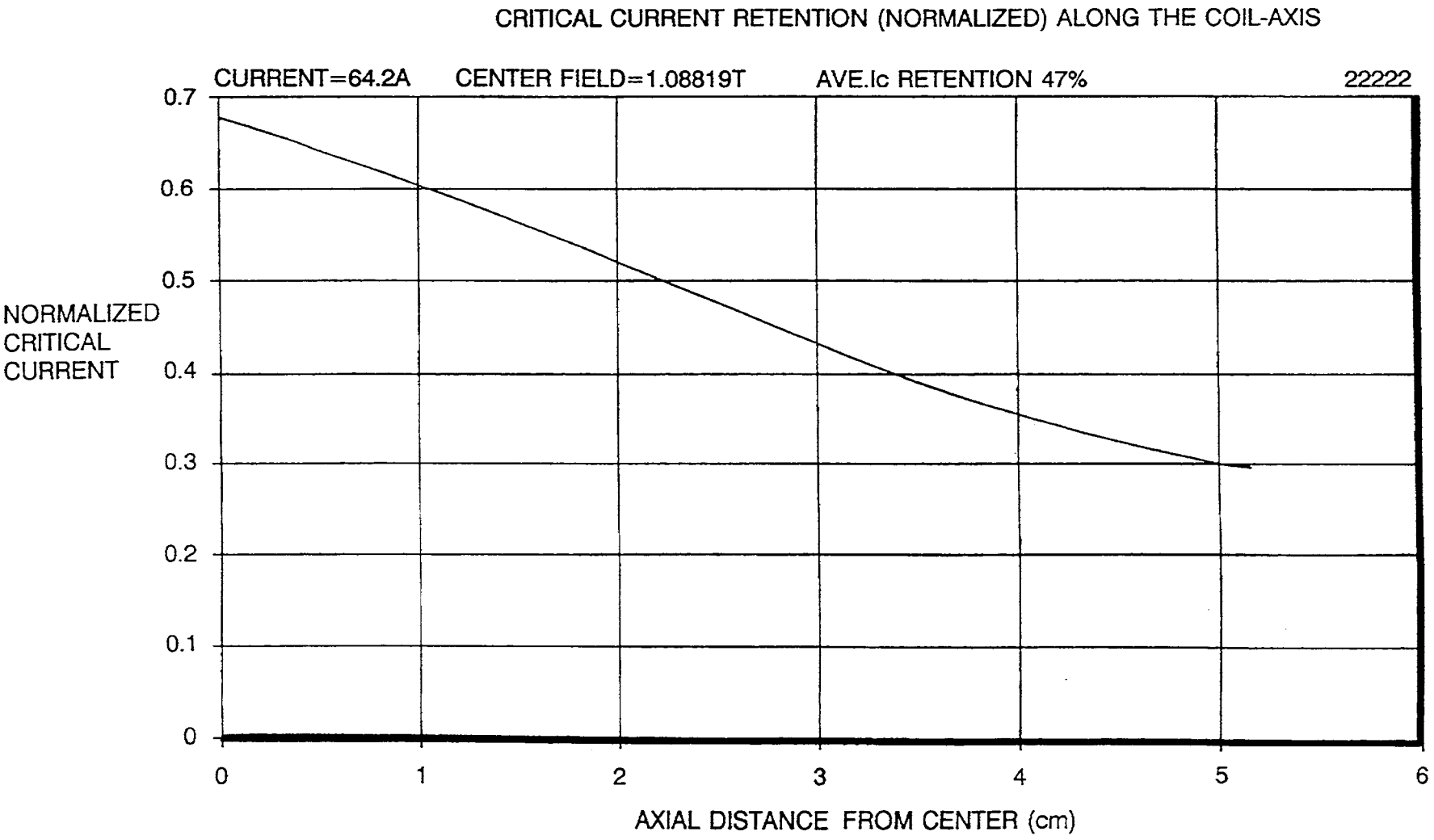
FIG. 10 is a graph showing the average normalized critical current distribution as a function of the axial length of the uniform current density superconducting coil.

FIG. 10 shows the average $I_c$ for the superconducting coil of Table I having a uniform current distribution as a function of the axial distance from the center of the coil. By estimating the average critical current for the different sections of a uniform current distribution coil, and noting their relative differences, a determination can be made as to what degree of change in the cross-sectional area of the conductor or type of superconductor is needed to increase the critical current values for sections having low critical current values, so that the critical current values of all the sections of the coil are relatively close in value to the critical current value associated with sections at the center of the coil.

As indicated in FIG. 10, the superconducting coil with the geometry described above in Table I, has an average normalized $I_c$ of approximately 0.68 (that is 68% of the critical current at zero field) for the region associated closest to the center of coil 10 and associated with pancake 12e. However, at the regions axially positioned approximately four centimeters from the center of coil (in the vicinity of pancakes 12a and 12i), the average normalized $I_c$ drops to about 0.35, approximately one-half that associated with pancake 12e. Thus, increasing the cross-sectional area of superconductor for pancakes 12a and 12i by an order of two would provide critical current values closer in value.

For example, in one embodiment, the cross section is increased at regions of the coil by bundling two conductors at center pancake 12e and pancakes 12d and 12f, three conductors for 12b, 12c, 12g, 12h, and four conductors for pancakes 12a and 12h at the ends of coil 10 to provide a gradual increase in the cross section of superconductor from the center region 30 to the end regions 36 of the graded superconducting coil. As shown in FIG. 4, in one embodiment, bundling of the superconductor can be achieved by increasing the number of overlaying wraps of the conductor tape between wraps of insulating tape.

In addition, the average $I_c$ for the entire coil is determined by averaging the $I_c$ over the individual pancakes and taking the length of the conductor used in that section as the averaging weight, expressed numerically as:

$$I_c(\text{coil ave}) = \frac{\Sigma(I_c \text{ of the pancake}) \times (\text{conductor length for the section})}{\text{total conductor length of the coil}}$$

Figure 11:
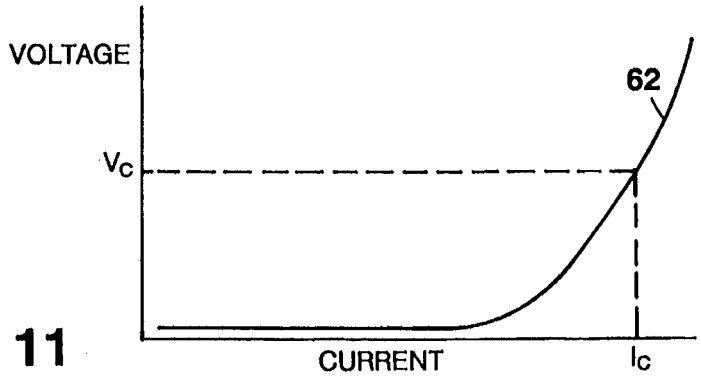
FIG. 11 is a graph showing the voltage-current characteristic of a superconducting coil.

Alternatively, a critical current value which more accurately represents the value of the critical current of the entire coil can be provided by determining critical voltage values (v) for different regions of the coil based on the following relationship:

$$(v/v_c)\ (i/i_c)^n$$

where $i_c$ is the critical current at that region;

$v_c$ is the critical current criterion which is dependent on the geometry of the conductor in that region;

and n is the index value as described in detail in Aized's article, *Comparing the Accuracy of Critical-Current Measurements Using the Voltage-Current Simulator*, referenced above and included as an appendix to this specification. Voltages (v) for each region are determined for each current level (i) and summed to provide a total voltage $V_T$ for that current level. Total voltages $V_T$ are then plotted as a function of current (line 62) and the above relationship is used to determine a total critical current criterion $V_c$ for the coil. This plotted function, as shown in FIG. 11, is then used to provide the critical current $I_c$ of the entire coil that is associated with $V_c$, In another approach for optimizing the distribution of superconductor for different regions of the coil, referred to as the "minimum $I_c$" approach, the $I_c$ values for positions throughout the coil are determined on the basis of a minimum critical current value positioned closely to the center of the coil. In this approach, the coil is partitioned into a large number of small regions each having an associated minimum $I_c$ value. The region closest to the center of the coil, both axially and radially, establishes a reference level for grading the remaining regions of the coil.

Figure 12:
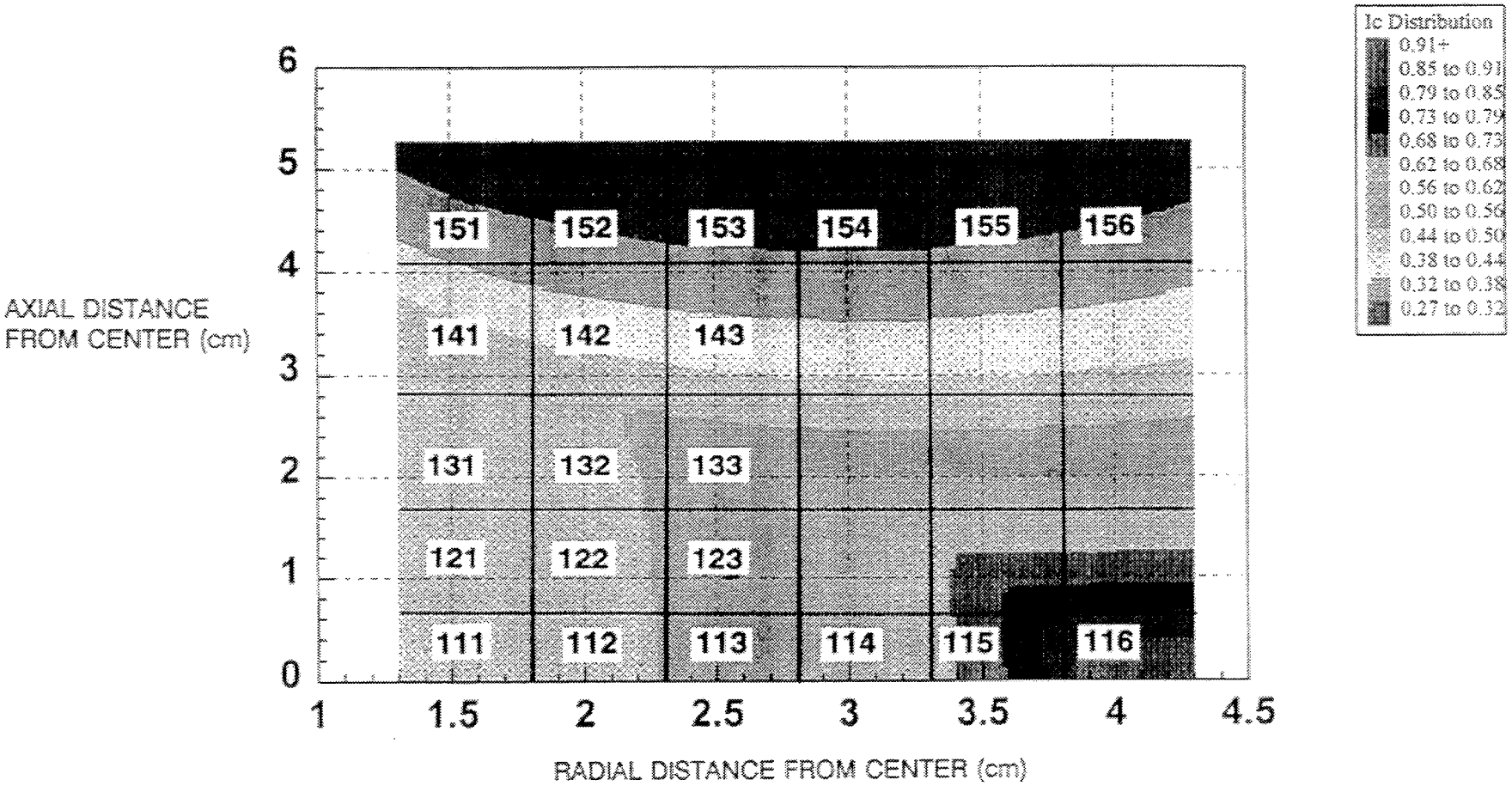
FIG. 12 is a plot showing the critical current distribution divided among regions for a superconducting coil.

For example, referring to FIG. 12, the same superconducting coil analyzed above in conjunction with FIG. 10, includes a region 111, positioned most closely, both axially and radially, to the center of the coil that includes a point within region 111 having a minimum normalized $I_c$ value of 0.44 (that is 44% of the critical current at zero field). This minimum normalized $I_c$ value establishes a reference to which all other minimum normalized values of the remaining regions are referenced. Thus, if the section of the coil associated with region 111 includes two bundles of superconductor (like pancake 12c in FIG. 4), regions 151–156, which are at the end regions of the coil and having minimum normalized $I_c$ values of 0.27, the degree of change needed to increase the critical current values for regions 151–156 so that they are close in value to the critical current value associated with the section closest to region 111 is about a three and one-third times the superconductor used at region 111 [(44/27)*(2)=3.3]. In this situation, regions 151–156 may either be wound with three superconductor bundles having a proportionally higher $I_c$ retention value or with four superconductor bundles having a proportionally lower $I_c$ retention value.

The minimum critical current at central region approach is generally considered to be a more conservative approach for determining the optimum distribution of conductor as compared to the critical current averaging approach because of its reliance on a minimum and not an average of critical current values. Thus, the minimum $I_c$ at central region approach is generally more suitable in the design of high performance superconducting magnets which are more likely to be operated very near the minimum critical current value of any part of the superconductor and are therefore, more susceptible to normal zone propagation.

Using the minimum $I_c$ at central region approach for the coil as defined in Table I resulted in a decrease in the G/A (gauss/ampere) rating of the entire coil from 172 G/A for a uniform current distribution coil (that is, a 22222 superconductor distribution) to 162 G/A for a graded coil having a 22234 superconductor distribution. This is due to the decrease in winding turns associated with low critical current sections and is not representative of the magnitude of the magnetic field at the center of the coil which is usually increased. Furthermore, the theoretical $I_c$ required to generate the desired one Tesla field at the center of the coil also decreased significantly from 215 A=(10000 /(172*0.27) to 140.3 A=(10000/(172*0.44).

By using either the "critical current averaging" or "minimum $I_c$" approaches, the cross-sectional area of the conductor for each of the pancakes can be changed to provide a higher average $I_c$ value for the coil and to provide $I_c$ values for all of the individual pancakes that are close in value (step 66). This objective can also be accomplished by changing the type of superconductor for each pancake proportionally to provide retention $I_c$ value closer to the maximum $I_c$ value.

Because the cross-sectional area or type of superconductor associated with the sections of the coil may be changed to increase the critical current at the regions of the coil in which that section is located, it is generally necessary to repeat steps 54–66 for the newly configured coil. Changing the distribution of conductor for the sections of the superconducting coil, requires that the field and critical current distributions, as well as field contributions of each of the sections of the new coil be redetermined (step 68). This is necessary because the change in the cross-sectional area or type of superconductor associated with each section changes the field characteristics associated with that section, as well as the entire coil. For example, because it is generally desirable that the volume of the superconducting coil be substantially maintained, increasing the cross section of the superconductor for a section of the coil will generally decrease the number of turns or windings in that section, thereby changing the magnetic field characteristics and the contribution toward the center field of the coil. However, because this change generally occurs at the end regions of the coil, where the critical current is lower (due to the substantially perpendicular orientation of the magnetic field), the lower magnetic field (due to the decrease in turns) does not significantly contribute to the magnitude of the center magnetic field. In other words, although there is generally a decrease in the magnitude of the magnetic field at the end regions of the coil, there is a relatively significant increase in the critical current and current carrying capacity of the coil.

The cross-sectional area of the superconductor or type of superconductor for each pancake, and thus their respective critical current values, can be iteratively adjusted until a desired average $I_c$ for the entire coil is achieved (that is, the $I_c$ when all the sections of the coil have nearly same $I_c$) (step 70). Statistical analysis can be used to calculate the standard deviation for the coil sections and to minimize its value by adjusting the number of conductors in the different sections of the coil. It is important to note that providing a greater number of superconductor bundles at center region 30 of coil 10 provides a greater number of bundles which can be used for sections of the coil intermediate center region 30 and end regions 36, and thus a smoother grading of the coil.

Figure 13:
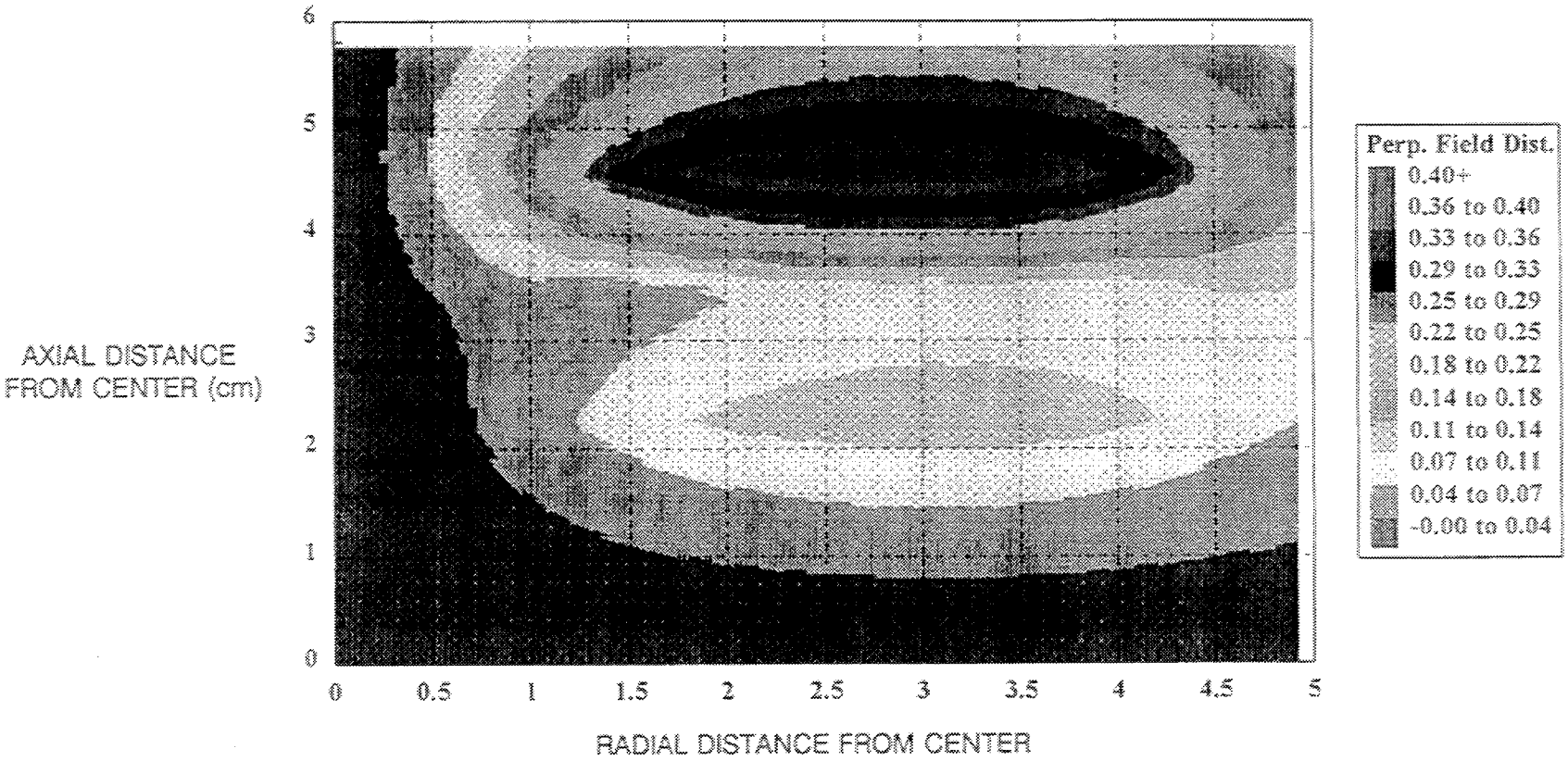
FIG. 13 is a plot showing the magnetic field distribution within a non-optimum superconducting coil having a non-uniform current distribution.

For the superconducting coil having the geometry described in Table I, the cross sections of pancakes **12*a*–12*i* were changed by varying the number of layers of superconductor as shown in FIG. 4 to provide a superconducting coil having an increased average critical current value, and hence an increase in the current carrying capacity and magnetic field for the coil. Table IV summarizes results after each iteration for the coil with the configuration arrangement (first column) describing the number of layers of conductor. For example, 22222 defines a uniform current density coil (that is, each pancake having one layer of conductor) while 22334 describes a configuration where the three inner-most pancakes 12*d*–12*f* have two layers, pancakes 12*b*, 12*c*, 12*g*, and 12*h* have three layers, while outermost layers 12*a* and 12*i* have four layers. This configuration (22334) was selected as having the most optimal arrangement because it provided a small variation ($I_c$ standard deviation=9.26) in the critical current over the coil volume while providing a large average $I_c$ (89.41A) and high magnetic field (1.357 T). Although, configuration 22344 also provided a relatively low standard deviation and higher average $I_c$ and magnetic field, the field distribution provided by this configuration, as shown in FIG. 13**, provided multiple areas (called "depressions") where the magnetic field intensity achieves a maxima for a field oriented perpendicularly to the conductor plane. Configurations having such field distributions degrade the overall performance of the superconducting coil.

TABLE IV

| Configuration | G/A | Ave. Ic (A) | Field (T) | $I_c$ Std. dev. (A) |
|---|---|---|---|---|
| 22222 | 172.80 | 63.23 | 1.142 | 17.09 (25.8%) |
| 22223 | 169.34 | 71.50 | 1.211 | 12.45 (17.4%) |
| 22233 | 163.77 | 77.75 | 1.273 | 9.51 (12.2%) |
| 22234 | 161.99 | 81.28 | 1.316 | 10.59 (13.0%) |
| 22334 | 151.87 | 89.41 | 1.357 | 9.26 (10.3%) |
| 22344 | 148.80 | 94.12 | 1.400 | 13.58 (14.4%) |

It is also important to note that the geometry of the different sections of the coil can also be varied along the radial axis of the coil, as opposed to along the longitudinal axis, as described above. For example, referring to FIG. 14, a cross-sectional view of a portion (one-half of one side) of an exemplary one of the double pancakes **12*a*–12*i* of FIGS. 1 and 2, shows that the number of bundled conductors 90 need not be the same throughout the pancake. In fact, in much the same way as the cross-sectional area of superconductor was varied along the longitudinal axis of the coil the cross-sectional area of the superconductor, can be varied along the radial axis of each section or pancake of the coil. For example, as is shown in FIG. 7**, the total magnetic field for the uniform distribution coil decreases from the inner to the outer radius of the coil. Thus, it is desirable to decrease the cross-sectional area at this region of the pancake, thereby allowing an increase in the number of turns of conductor, which increases the central magnetic field of the coil.

Figure 15:
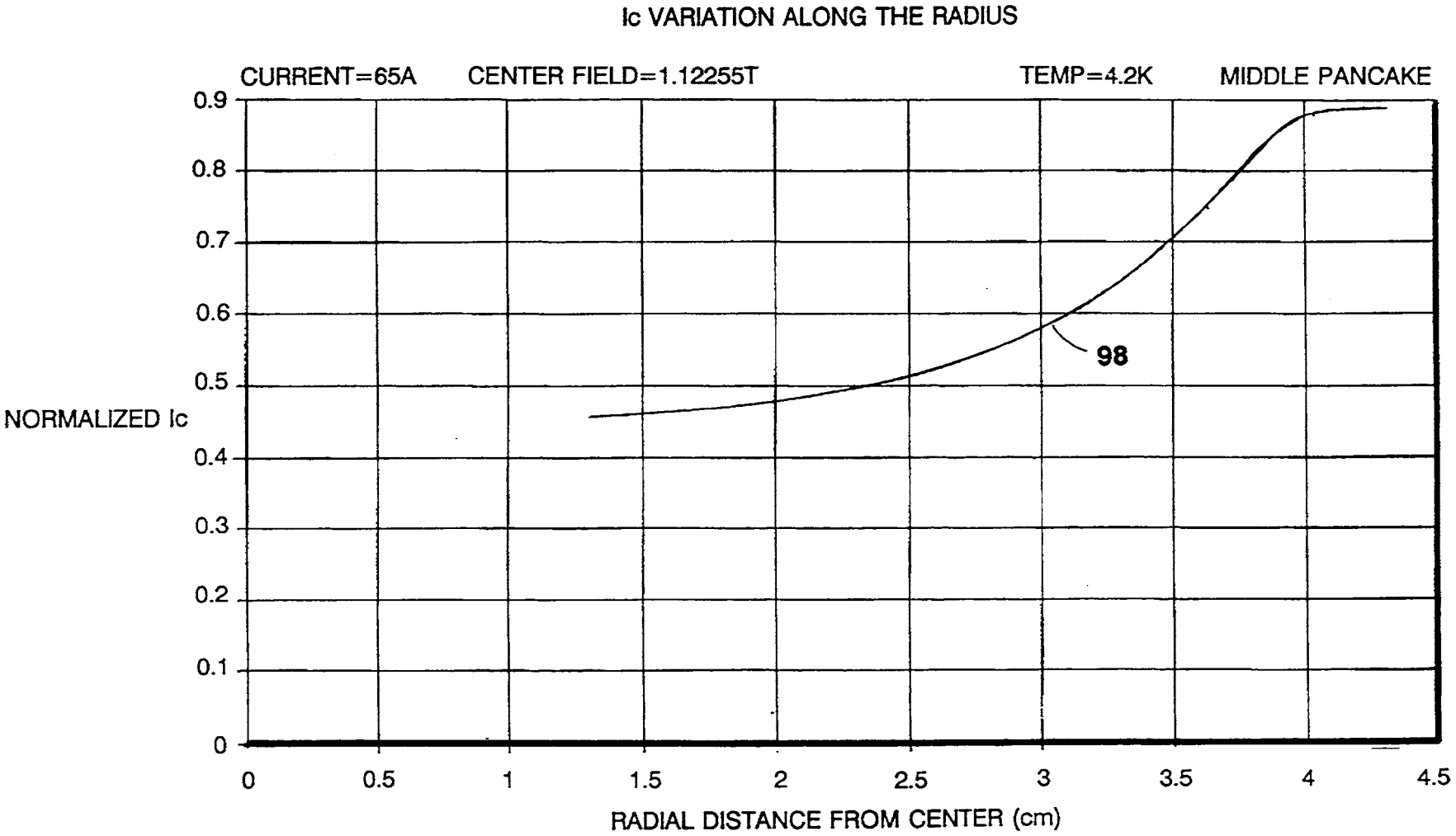
FIG. 15 is a graph showing the average normalized critical current distribution as a function of the radius of the uniform current density superconducting coil.

Using a critical current averaging approach, a weighted average of all $I_c$ values extending axially within the region for each radial position of the pancake is determined in much the same way as was described above in conjunction with averaging for each axial position of the coil. Referring to FIG. 15, the average normalized $I_c$ (line 98) for the middle pancake **12*e* of the superconducting coil of Table I having a uniform current distribution can be plotted as a function of the radial distance from the center of the coil. Note that the inner radius of the pancake is about 1.3 cm from the center of the coil. A determination can then be made as to what degree of change in the cross-sectional area of the conductor is needed to increase the critical current values for regions having low critical current values within the coil by observing the relative difference in average critical current between the different sections of the uniform current distribution coil. Similarly, the critical current distribution data, as shown in FIG. 12**, indicates regions along the radial axis of the coil having low $I_c$ values which should be increased when the "minimum critical current" approach is used.

Thus, either the "critical current averaging" or "minimum $I_c$" approaches, described above, can be used to change the cross-sectional area of superconductor within each of the pancakes to provide a higher average $I_c$ value for the coil and to provide $I_c$ values for all of the individual pancakes that are substantially equivalent.

In general, the $I_c$ increases from the center to the outer windings of the coil and, therefore, it is generally desirable to provide superconductor of greater cross-sectional area at the regions closer to the center (that is, internal windings) than at regions radially outward. For example, referring again to FIG. 14, if three conductors are bundled at portion 94 (associated with, for example, regions 111–113), only two conductors would be required at portion 96 (associated with outermost radial regions 114–116) of the coil. During the fabrication of one embodiment of a pancake, coil, the three conductors are wound around the coil until the radial distance at which it is desired to reduce the number of conductors is reached. At this point, one of the conductors is cut leaving an end which is attached, for example, by soldering, to an adjacent one of the remaining conductors, and winding of the coil is continued. By decreasing the number of conductors of a coil at regions where the critical current has a sufficiently high value allows a greater number of turns to be wound on the coil at these regions, thereby increasing the magnetic field provided by the coil.

APPENDIX I

TITLE: SUPERCONDUCTING MAGNETIC COIL

APPLICANT: DAWOOD AIZED, ROBERT E. SCHWALL

53 pages of Specification 19 pages of Claims

1 Abstract page

9 Sheets of Drawings

Superconducting Wind-and-React Coils and Methods of Manufacture

Abstract of the Disclosure

A process for manufacturing superconducting magnetic coils from strain-tolerant, superconducting multi-filament composite conductors is described. The method involves winding the precursor to a multi-filament composite conductor and an insulating material or its precursor around a mandrel in order to form a coil, and then exposing the coil to high temperatures and an oxidizing environment. The insulating material or its precursor is chosen to permit exposure of the superconductor precursor filaments to the oxidizing environment, and to encase the matrix-forming material enclosing the filaments, which is reversibly weakened during processing.

ATTORNEY DOCKET NO: 05770/004001

Superconducting Wind-and-React Coils and Methods of Manufacture

The invention relates generally to superconducting magnetic coils and methods for manufacturing them. In particular, the invention relates to a wind-and-react process used to produce mechanically robust, high temperature superconducting coils which have high winding densities and are capable of generating large magnetic fields.

Background of the Invention

The wind-and-react method involves winding the precursor to a superconducting material around a mandrel in order to form a coil, and then processing the coil with high temperatures and an oxidizing environment. The processing method results in the conversion of the precursor material to a desired superconducting material, and in the healing of micro-cracks formed in the precursor during the winding process, thus optimizing the electrical properties of the coil.

Superconducting magnetic coils, like most magnetic coils, are formed by wrapping an insulated conducting material around a mandrel defining the shape of the coil. When the temperature of the coil is sufficiently low that the conductor can exist in a superconducting state, the current-carrying performance of the conductor is markedly increased and large magnetic fields can be generated by the coil.

Certain ceramic materials exhibit superconducting behavior at low temperatures, such as the compound $Bi_2Sr_2Ca_{n-1}Cu_nO_{2n+4}$ where n can be either 1, 2, or 3. One material, $Bi_2Sr_2Ca_2Cu_3O_{10}$ (BSCCO (2223)), performs particularly well in device applications because superconductivity and corresponding high current densities are achieved at relatively high temperatures ($T_c$ = 115 K). Other oxide superconductors include general Cu-O-based ceramic superconductors, such as members of the rare-earth-copper-oxide family (ie., YBCO), the thallium-barium-calcium-copper-oxide family (ie., TBCCO), the mercury-barium-calcium-copper-oxide family (ie., HgBCCO), and BSCCO compounds containing lead (ie.,$(Bi,Pb)_2Sr_2Ca_2Cu_3O_{10}$).

Insulating materials surrounding the conductor are used to prevent electrical short circuits within the winding of a coil. From a design point of view, the insulation layer must be able to withstand large electric fields (as high as 4 X $10^5$ V/cm in some cases) without suffering dielectric breakdown, a phenomenon that leads to electrical cross-talk between neighboring conductors. At the same time insulation layers must be as thin as possible (typically less than 50 - 150 $\mu$m) so that the amount of superconducting material in the coil can be maximized.

Using existing conducting and insulating materials, the maximum magnetic field generated by a superconducting coil is ultimately determined by the winding density (defined as the percentage of the volume of the coil occupied by the conductor) and the coil geometry. However, the large tensional forces necessary for high winding densities can leave conductors in highly stressed and/or strained states. The bend strain of a conductor, equal to half the thickness of the conductor divided by the radius of the bend, is often used to quantify the amount of strain imposed on the conductor through coil formation. Many superconducting magnet applications involving high-density conductor windings require conductor bend strains on the order of 0.2%, and in some cases much higher. The critical strain of a conductor is defined as the amount of strain the material can support before experiencing a dramatic decrease in electrical performance. The critical strain value is highly dependent on the formation process used to fabricate the conductor, and is typically between 0.05% - 1.0%, depending on the process used. If the bend strain exceeds the critical strain of a conductor, the current-carrying capability of the conductor, and hence the maximum magnetic field generated by a coil, will be decreased significantly.

One approach to manufacturing high-performance conductors having desirable mechanical properties involves starting with a precursor to a high temperature superconducting material, typically a ceramic oxide in a powder form. Despite relatively poor mechanical properties and more complex manufacturing processes which requires high temperatures and an oxidizing environment, high temperature superconducting materials are preferred to low temperature superconducting materials for certain applications because they operate at higher ambient temperatures. Oxide powders are packed into a silver tube (chosen because of malleability, inertness, and high electrical conductivity) which is then deformed and reduced in size using standard metallurgical techniques: extrusion, swaging, and drawing are used for axisymmetric reductions resulting in the formation of rods and wires, while rolling and pressing are used for aspected reductions resulting in the formation of tapes and sheets (Sandhage et al., "Critical Issues in the OPIT Processing of High-Ic BSCCO Superconductors", Journal of Metals 3, 21, 1991).

Following the deformation process, heating and cooling results in the growth and evolution of individual crystalline oxide superconductor grains in the conductor which typically take on a rectangular platelet shape. Further deformation results in a collective alignment of the crystallographic axes of the grains. An iterative heating/deforming schedule unique to the ceramic oxide forms of superconductors is typically carried out until the desired grain size, alignment, and density of the superconducting state are achieved.

Conductors having a single oxide core, classified as mono-filament composite conductors, result from the iterative schedule described above and can have critical strain values as high as 0.1%. Mono-filament composite conductors can be transformed into multi-filament composite conductors using a rebundling fabrication operation involving further reduction in size of the mono-filament composite conductors, and finally concatenation of individual conductors to form a single conductor. Typically, the evolution of cracks in response to bend strains is more likely in mono-filament composite conductors than in multi-filament composite conductors, where critical strain values increase with the number of filaments in the conductor, and can be greater than 1.0%. Other limitations of mono-filament composite conductors include decreases in crack healing ability and oxygen access to the conductor during processing. Furthermore, because mono-filament composite conductors have only a single superconducting region, it is difficult to control the conductor size and shape, and mechanically robust conductors can not be easily fabricated (K. Osamure, et al., Adv. Cryo. Eng., ICMC Supplemental, 38, 875, 1992). Thus, multi-filament composite conductors have desirable mechanical properties, and can be used in coils requiring high winding densities.

One method used to fabricate coils with multi- and mono-filament composite conductors is the react-and-wind process. This method first involves the formation of an insulated composite conductor which is then wound into a coil. In this method, a precursor to a composite conductor is fabricated and placed in a linear geometry, or wrapped loosely around a coil, and placed in a furnace for processing. The precursor can therefore be surrounded by an oxidizing environment during processing, which is necessary for conversion to the desired superconducting state. In the react-and-wind processing method, insulation can be applied after the composite conductor is processed, and materials issues such as the oxygen permeability and thermal decomposition of the insulating layer do not need to be addressed.

In the react-and-wind process, the coil-formation step can, however, result in straining composite conductors in excess of the critical strain value of the conducting filaments. Strain introduced to the conducting portion of the wire during the deformation process can result in micro-crack formation in the ceramic grains, severely degrading the electrical properties of the composite conductor.

Another method used to fabricate magnetic coils with mono-filament composite conductors is the wind-and-react method. In this method, the eventual conducting material is typicallly considered to be a "precursor" until after the final heat treating and oxidation step. Unlike the react-and-wind process, the wind-and-react method as applied to high temperature superconductors requires that the precursor be insulated before coil formation, and entails winding the coil immediately prior to a final heat treating and oxidation step in the fabrication process. This final step results in the repair of micro-cracks incurred during winding, and is used to optimize the superconducting properties of the conductor. However, these results are significantly more difficult to achieve for a coil geometry than for the individual wires which are heat treated and oxidized in the react-and-wind process.

Due to the mechanical properties of the conducting material, superconducting magnetic coils fabricated using the wind-and-react approach with mono-filamentary composite conductors have limitations related to winding density and current-carrying ability. Although the wind-and-react process may repair strain-induced damage to the superconducting material incurred during winding, the coils produced are not mechanically robust, and thermal strain resulting from cool down cycles can degrade the coil performance over time.

A feature of the invention is a wind-and-react process which is used to manufacture superconducting magnetic coils with multi-filament composite conductors. This processing method can be used to manufacture several variations of coils types, all of which are discussed below.

An advantage of the invention is ability to produce mechanically robust coils requiring high winding densities, without significantly degrading the superconducting properties of the multi-filament composite conductors used to form the coils.

Summary of the Invention

The present invention relates to a wind-and-react processing method used to fabricate superconducting magnetic coils featuring strain-tolerant multi-filament composite conductors. This invention has various aspects which individually contribute improvement over previous react-and-wind coils, and wind-and-react coils made with mono-filament conductors. Specifically, materials and processing steps have been adapted in order to fabricate coils which allow adequate oxygen access to the precursor to the multi-filament composite conductor in order to affect conversion to the desired superconducting state, while at the same time allowing preservation of the materials and geometrical tolerances of the coil. Superconducting coils requiring high-density complex winding geometries can often only be fabricated with multi-filament composite conductors because mono-filament conductors are intrinsically less flexible and their electrical properties are more difficult to rehabilitate.

In one aspect, the invention relates to a method for producing a superconducting magnetic coil featuring the following steps: fabricating a precursor to a multi-filament composite conductor from multiple high-temperature superconducting filaments enclosed in a matrix-forming material; surrounding the precursor to the multi-filament conductor with an insulating layer or a precursor to an insulating layer; forming the precursor to the multi-filament composite conductor as a coil; heat treating the coil after the forming step by exposing the coil to high temperatures in an oxidizing environment, the superconductor precursor filaments being oxidized and the matrix-forming material reversibly weakening during the heat treating step, with the composition and thickness of the insulating layer or precursor to the insulating layer bein chosen to encase the matrix-forming material and the superconductor precursor filaments, and to permit exposure of the superconductor precursor filaments to oxygen during the heat treating step. The heat treating step results in the improvement of the electrical and mechanical properties of the superconductor precursor filaments, and in the formation of a superconducting magnetic coil.

By "surrounding" the eventual multi-filament composite conductor with an insulating layer (or precursor to an insulating layer), direct contact between adjacent conductors is prevented. By "encasing" the matrix-forming material and the superconducting precursor filaments during the heat treating step, the insulation layer (or precursor to the insulation layer) preserves the integrity of the coil during the heat treatment. By "reversibly weakening" the matrix-forming material is left essentially without mechanical strength during the heat treating step, with the material substantially regaining mechanical stability following processing.

Preferably, the heat treating step involves heating and then cooling the coil in an environment comprising oxygen, and results in the conversion of the superconductor precursor filaments to a desired superconducting material, and in the repair of micro-cracks formed in the filaments during the forming step.

In preferred embodiments, the heat treating step features heating the coil from room temperature at a rate of about 10 °C/min. until a temperature between 765 °C and 815 °C, and preferably 787 °C is obtained; heating the coil at a rate about 1 °C/min. until a maximum temperature between 810 °C and 860 °C, and prefably 830 °C, is obtained; heating the coil at the maximum temperature for a time between 0.1 and 300 hours, and preferably for 40 hours; cooling the coil at a rate of about 1 °C/min until a temperature between 780 °C and 845 °C, and preferably 811 °C, is obtained; heating the coil at this temperature for a time period in the range of 1 to 300 hours, and preferably for 120 hours; cooling the coil at a rate of about 5 °C/min. to a temperature between 765 °C and 815 °C, and preferably 787 °C; heating the coil at this temperature for a time period between 1 and 300 hours, and preferably for 30 hours; and, finally cooling the coil at a rate of about 5 °C/min. until a temperature of 20 °C is reached, with the heat treating steps performed in an atmosphere which consists primarily of gaseous oxygen at a pressure of about 0.001 to 1 atm, and preferably at 0.075 atm.

In one preferred embodiment of the invention, the coil is formed by repeating the steps of first winding a layer of the precursor to the multi-filament composite conductor around a mandrel, and then winding a layer of material comprising an insulating material or a precursor to an insulating material on top of the precursor to the multi-filament composite conductor. In another preferred embodiment of the invention, the precursor to the insulating material is initially a liquid mixture of a solvent and dispersant, and a particulate material, with the mixture being applied by dipping the precursor to the multi-filament composite conductor in the liquid mixture, followed by a heating step which results in the evaporation of the solvent and dispersant, and the formation of an insulating layer around the precursor to the multi-filament composite conductor. In a preferred embodiment of the invention, a heating step is used to remove impurities from the insulating material, such as dirt or a binder material.

In another preferred embodiment of the invention, the coil forming step features the step of concentrically winding the precursor to the multi-filament composite conductor to form a multi-layer coil having a "pancake" shape, with each of the layers wound to overlap the preceding layer. Each edge of the entire length of the precursor to the multi-filament composite conductor in this geometry is exposed to the oxidizing environment during a heat treating step. The heat treatment results in the oxidation and healing of micro-cracks in the superconductor filaments of the precursor to the multi-filament composite conductor, resulting in the formation of a multi-filament composite conductor. The "pancake" coil can be wound around a mandrel having an arbitrary shape. In preferred embodiments, the "pancake" coil is wound around a mandrel having a circular cross section. In alternate embodiments, the mandrel cross section is primarily elliptical in shape. In preferred embodiments, double "pancake" coils can be formed by winding a second "pancake" coil on the mandrel adjacent to the first "pancake" coil. In yet other preferred embodiments of the invention, multiple double "pancake" coils can be combined to form a single coil, and are preferably stacked in a coaxial manner.

In one particular aspect of the invention, a method for producing a superconducting magnetic coil, similar to the method described above, features subjecting the precursor to the multi-filament composite conductor to a bend strain in excess of its critical strain. In a particular embodiment of the invention, the precursor to the multi-filament composite conductor is subjected to a bend strain in excess of 0.3%.

In another particular embodiment, each layer of the multi-filament composite conductor of the coil consists of multiple conductors, with all of the conductors surrounded by a single insulating layer. Preferably, the multi-filament composite conductor has multiple superconducting filaments enclosed in a matrix-forming material composed of a noble metal or an alloy to a noble metal, and is preferably made of silver. In a particular embodiment, the superconducting material used for the filaments is selected from the oxide superconductor family, comprising the following materials: $(Bi,Pb)_2Sr_2Ca_{n-1}Cu_nO_{2n+4}$, where n is equal to either 1, 2, or 3; members of the rare earth-copper-oxide family, such as YBCO (123), YBCO (124), and YBCO (247); members of the thallium-barium-calcium-copper-oxide family, such as TBCCO (1212) and TBCCO (1223); and, members of the mercury-barium-calcium-copper-oxide family, such as HgBCCO (1212) and HgBCCO (1223). Preferably, three-layer phase BSCCO is used for the superconducting filaments.

In preferred embodiments of this aspect of the invention, the multi-filament composite conductor is surrounded by an insulating layer which is permeable to gaseous oxygen and substantially chemically inert relative to the multi-filament composite conductor. In a preferred embodiment, an insulating material selected from the group containing $SiO_2$, $Al_2O_3$, and zirconia fibers is used as the insulating layer. Preferably, the insulating material is co-wound with the precursor to the multi-filament composite conductor. In alternate embodiments, the insulating material is wrapped around the precursor to the multi-filament composite conductor. Preferably, the thickness of the insulating layer is between 10 and 150 $\mu$m. In other embodiments, the insulating layer of the coil consists primarily of a particulate material selected from a group comprising $Al_2O_3$, MgO, $SiO_2$, and zirconia.

In particular aspects of the invention, a superconducting magnetic coil made with the method described above has an inner-coil diameter no larger than about 1 cm, or alternatively, the coil is wound so that the bend strain of the multi-filament composite conductor is greater than 0.3%. In other aspects of the invention, the winding density of the coil is greater than about 60%, the fill factor of the multi-filament composite conductor is greater than about 30%, the minimum critical-current is about 1.2 Amperes, and the magnetic field produced by the coil is in excess of about 80 Gauss.

In one aspect of the invention, a "pancake" coil is formed by the method described above. In a preferred embodiment, each layer of insulated multi-filament composite conductor of the "pancake" coil consists of multiple strands of multi-filament composite conductor, each having multiple superconducting filaments, with all strands surrounded by a single insulation layer. The conducting and insulating materials used in the "pancake" coil are the same as those described previously. In one embodiment of the invention, the coil is impregnated with a polymer. In a preferred embodiment, double "pancake" coils can be formed. Double "pancake" coils can be stacked coaxially and adjacent to each other. In certain preferred embodiments, the mandrel supporting the stacked coils is removed.

Brief Description of the Drawings

Other objects, features and advantages of the invention will be apparent from the following description, taken together with the following drawings.

Figure 1 is a cross-sectional view of a multi-filament composite conductor.

Figure 2 is a graph comparing the electro-mechanical properties of mono- and multi-filament composite conductors.

Figure 3 is a graph comparing the electrical properties of coils made with mono- multi-filament composite conductors as a function of thermal cycles.

Figure 4 is a block diagram of the wind-and-react coil formation process.

Figure 5 illustrates a coil winding device.

Figure 6 is a graph illustrating the mechanical properties of superconducting multi-filament composite conductor manufactured in accordance with the invention.

Figure 7 is a graph showing critical-current density plotted against bend strain for a particular multi-filament composite conductor which was heat treated in accordance with the invention after being strained.

Figure 8 is a graph comparing the electro-mechanical properties of composite conductors treated with wind-and-react and react-and-wind processing methods.

Figure 9:
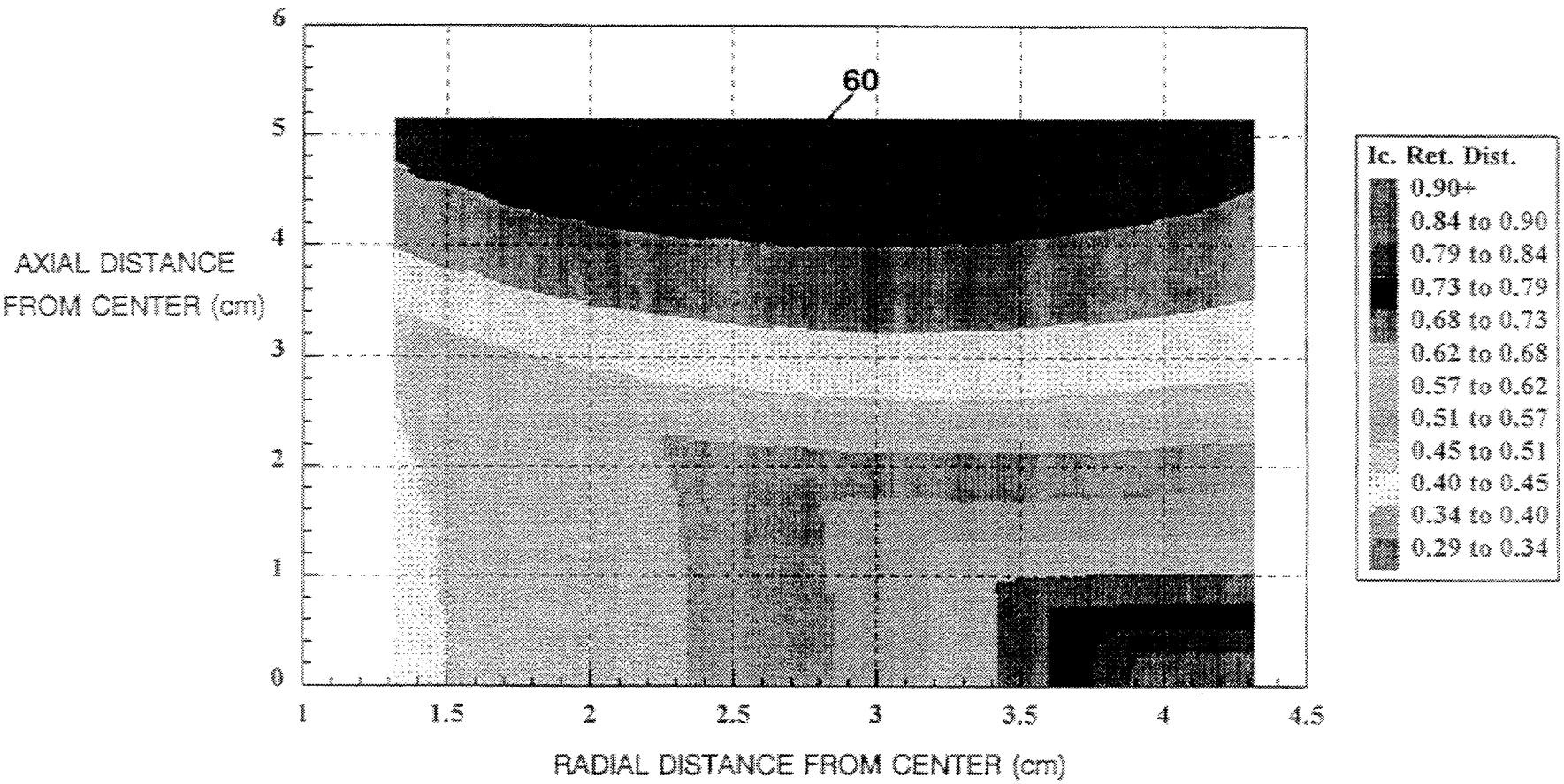
FIG. 9 is a plot showing the normalized critical current distribution within the uniform current density superconducting coil.

Figure 9 shows a superconducting coil made with a multi-filament composite conductor using the wind-and-react process in accordance with the invention.

Figure 10 shows a superconducting coil in the "pancake" geometry made in accordance with the invention.

Figure 10a shows a side view of the coil.

Figure 10b shows a side view of a primarily elliptical "racetrack" coil.

Figure 11 shows multiply stacked "pancake" coils.

Figure 11a shows a cross-sectional view of Figure 11 taken along line 11a-11a.

Description of the Preferred Embodiments

Insulated Composite Conductor

Referring to Figure 1, a multi-filament composite conductor 11 manufactured in accordance with the invention and used in a superconducting coil has superconducting regions 12 which are approximately hexagonal in cross-sectional shape and extend the length of the multi-filament composite conductor 11. Superconducting regions 12 form the filaments of the conductor, and are surrounded by a matrix-forming material 14, which is typically silver or another noble metal, which conducts electricity, but is not superconducting. Together, superconducting regions 12 and the matrix-forming material 14 form the multi-filament composite conductor.

In the Figure, the composite conductor is encased in an insulating ceramic layer 15. A standard "fill factor" describing the cross-sectional area encompassed by the superconducting regions 12 relative to the overall conductor cross-sectional area is 28%. The thickness of the ceramic insulation layer is typically on the order of 10 and 150 μm.

Multi-filament composite conductors offer many advantages over mono-filament composite conductors having similar fill factors. Referring now to Figure 2, the electro-mechanical properties of multi- and mono-filament composite conductors are compared by plotting normalized critical-current density as a function of bend strain for different conductor samples having similar fill factors. The critical-current density of the mono-filament composite conductor approaches zero for bend strains near 1%, while the multi-filament composite conductor samples show a much weaker dependence on the bend strain. Both composite conductor samples had a thickness of 2.4 mm and a rectangular-shaped cross section, and were 10 cm in length. As the number of superconducting regions is increased from 7 to 2527, the conductive properties become less sensitive to bend strain, indicating the benefits of multi-filament composite conductors.

In the method of the present invention, the processing conditions used for the formation of the superconducting state have been inventively adapted to deal with problems unique to coils made with multi-filament composite conductors. In addition to the multi-filament composite conductor, materials used for insulation, mandrels, and other parts of the coil are subjected to the final heat treating process, and have been specifically chosen to adapt to the method of the present invention.

Wind-and-React Processing Method

Precursor Formation

The formation of the precursors to multi-filament composite conductors has been described previously, and will be discussed only briefly here (Riley et al., supra, and Sandhage et al., supra, the contents of which are incorporated herein by reference).

Referring now to Figure 4, the steps of the wind-and-react manufacturing process for forming magnetic coils having strain-tolerant multi-filament composite conductors begins with the precursor to a multi-filament composite conductor 20 comprising filaments which consist of the ceramic precursor to the eventual superconducting material. The precursor to the multi-filament composite conductor is processed with two distinct steps: 1) a deformation through a pressing and/or rolling step 21, resulting in an alignment of the ceramic material along the c axis of the single crystal grains; and 2) a sintering step 22 involving heating the precursor to the conductor to temperatures in excess of 800°C in an oxidizing environment, resulting in the formation of intergrannular connectivity. The precursor to the multi-filament composite conductor is returned to the deformation step 21 after being cooled. This results in crystallization and evolution of the superconducting grains, which is necessary, but not sufficient, for superconductivity. The deformation and sintering schedule is repeated iteratively from step 1 to step n-1, where n is an integer. The number of steps is chosen to optimize the final conduction properties of the target superconductor. For BSCCO (2223), the number "n" of steps is typically 2 or 3 using the heat treatments described herein.

Both the material and number of filaments used in superconducting regions can be changed to modify the electrical and mechanical properties of the eventual conductor. For example, in the BSCCO family, the number of layers of sheet-like CuO planes distinguish the different superconducting compounds. Along with BSCCO (2223), which has a three-layer phase, BSCCO (2201) (single-layer phase) and BSCCO (2212) (two-layer phase) are compounds which also exhibit superconductivity. BSCCO compounds may also contain lead which can result in the improvement of the chemical stability of the materials at high temperatures. The critical temperature ($T_c$) increases with increasing numbers of layers, with the single-layer phase having a $T_c$ of about 20 K, the two-layer phase having a $T_c$ of about 90 K, and the three-layer phase having a $T_c$ of about 115 K. Other desirable oxide superconductors, such as YBCO (123), TBCCO (1212) and TBCCO (1223), have values of $T_c$ in excess of 77 K.

A rebundling process results in fabrication of the precursors to multi-filament composite conductors having a variable number of sections, with each section containing multiple filaments (Sandhage et al., supra). Typically, using the described process, multi-filament composites composed of two sections have 7 filaments, composites composed of 3 sections have 19 filaments, and composites composed of 4 sections have 37 filaments.

Referring again to Figure 1, the matrix-forming material 14 is chosen to surround the superconducting regions 12 because of the malleability and nobility of the metal with respect to the superconducting material. The matrix-forming material 14 also protects the superconducting regions 12 from chemical corrosion and mechanical abrasion, and enhances the stability of the superconducting regions 12 at cryogenic temperatures. Although silver is the preferred material, the matrix-forming material can also be made of other metals exhibiting similar mechanical, chemical, and electrical properties, such as alloys of silver and other noble metals.

Insulation

In the wind-and-react process, insulation (or a precursor to an insulating material) is applied to the precursor to the composite conductor prior to the final heat treating step. A particular method for applying insulation to wires used in react-and-wind coils has been described previously in Woolf, U.S. Patent 5,140,006. The insulating methods and material parameters described herein have been specifically adapted for the wind-and-react method used to fabricate coils with multi-filament composite conductors.

The coil geometry imposes constraints on the insulation that are not present for individual wires. In the method of the present invention, ceramic insulation is chosen to insulate the multi-filament composite conductor because certain ceramic materials are permeable to oxygen, which allows exposure of the precursor to the composite conductor to an oxidizing environment during processing. Ceramic materials can also withstand the high temperatures an oxidizing environment of the processing conditions without suffering decomposition. Because insulation prevents electrical short circuits within the wound coil, ceramic materials are further desirable because they can withstand dielectric breakdown when exposed to electric fields as high as 4 x $10^5$ V/cm. Other materials exhibiting electrical and mechanical properties similar to ceramic materials could also be used as insulation.

Wind-and-react coils formed with multi-filament composite conductors have different insulation thickness requirements than wind-and-react coils formed with mono-filament wires. It is well known in the art that thin superconducting regions are necessary to obtain high critical-current densities for the BSCCO family of superconductors. The optimum current-carrying performance for mono-filament composite conductors is normally achieved when the thickness of the superconducting regions is on the order of 10 $\mu$m. In comparison, the thickness of multi-filament composite conductors is a function of the number and configuration of the superconducting regions, and can be flexibly controlled. Thus, the ratio of the thickness of the insulation layer relative to the conducting region can be decreased in multi-filament composite conductors. This also allows robust multi-filament composite conductors to be fabricated which can be made arbitrarily thick, and far less susceptible to damage during processing steps than their necessarily thinner mono-filament counterparts.

During the final heat treatment, the insulation also acts as a casing which holds the matrix-forming material (which is considerably weakened during heat treating) and the superconductor precursor together, and therefore must not be susceptible to decomposition. Furthermore, it is undesirable for the insulating material to react with the composite precursor during the heat treating. Materials such as chromium, which may be present in some ceramic materials, can diffuse through silver and may react with the superconducting material. Quartz, alumina, zirconia, and magnesium are not able to diffuse through the silver matrix-forming material at high temperatures, and do not decompose when subjected to high temperatures, and thus represent suitable materials for insulation.

In some cases, the material used to insulate the conductor is considered to be a precursor until a heating step is performed, resulting in the formation of the insulating layer. Alternatively, the insulating material may not exist in a precursor state. In this case, a heating step may be used to remove dirt and other impurities, although such a heating step may not necessarily alter the chemical composition of the insulating material. In addition, a heating step may improve the mechanical properties of the insulation without changing the actual insulation properties.

Ceramic materials used as the precursors to insulation materials can be in the form of either a solid, such as a tape containing ceramic fibers, or a slurry, defined as a mixture of a solid particulate suspended by liquid. In a preferred embodiment, a cloth containing $SiO_2$ fibers is used as the insulating material. This material does not exist in a precursor state, but a heating step may result in the removal of dirt and other impurities, thus improving the robustness of the cloth.

Suitable solid-based materials should be flexible so that they can be formed into a coil with the precursor to the conductor, while liquid-based materials should adhere to the precursor to the conductor, forming a continuous coating. Ceramic slurries and cloths both containing insulating materials may be used as the liquid-based and solid-based materials, respectively.

In a preferred embodiment of the present invention, a solid-based insulating layer is formed by attaching a cloth material composed of quartz fibers having a thickness between 10 - 250 $\mu$m and a width equal to the width of the precursor to the composite conductor. Quartz cloth is porous, and is chosen because of strength, flexibility, and its ability to resist degradation when exposed to high temperatures. In alternate embodiments, cloths woven from other ceramic fibers, such as zirconia and $Al_2O_3$, are used. Typically, a binder composed of an adhesive polymer is used to hold the fibers of the cloth together. The insulation can be applied by co-winding a single layer of the cloth during the coil formation step, or braiding multiple layers of the cloth around the precursor to the conductor at any time prior to the coil formation step. The binder of the ceramic insulating cloth can be removed by subjecting the insulation to a heating step following coil winding. This typically involves exposing the cloth to a temperature greater than about 450 °C for a time period of about 3 hours. Alternatively, the heat treating steps used to optimize the electrical and mechanical properties of the composite conductor can be used to remove the binder.

In an alternate embodiment, a liquid-based insulation layer is formed around the precursor to the multi-filament composite conductor as described in U.S. Patent 5,140,006, which is herein incorporated by reference. The insulating layer is formed by first immersing the precursor to the multi-filament composite conductor in the slurry, resulting in adhesion of the particulate to its outer surface. The precursor to the conductor is then removed from the slurry, and subjected to a processing step consisting of heating the particulate material to a temperature of greater than 600 °C for a time period of about 15 hours, resulting in the calcination of the particulate material and the formation of the insulation layer. The liquid-based insulation layer can also be calcined during the heat treating steps of the processing method used to optimize the electrical an mechanical properties of the conductor. Both heating processes result in the formation of the ceramic insulating layer and the evaporation and decomposition of the solvent/dispersant, leaving a thin ceramic film having a thickness typically between 1 and 150 μm.

Coil Formation

Oxidation of the precursor to the multi-filament composite conductor during heat treatment is crucial to the overall performance of the superconducting material. Steps must therefore be taken to insure that precursors to composite conductors wound into coils have adequate access to the oxidizing environment. One way to accomplish this is by forming a "pancake" coil in which the precursor is formed into a tape and wrapped in concentric layers around a mandrel to form a spiral pattern, with each layer wound directly on top of the preceding inner layer. This allows the outer edge of the precursor to be exposed to the oxygen atmosphere along its entire length during the final step of the wind-and-react processing method.

Referring to Figure 5, in a preferred embodiment of the invention, a mandrel 30 is held in place by a winding flange 32 mounted in a lathe chuck 31, which can be rotated at various angular speeds by a device such as a lathe or rotary motor. The precursor to the multi-filament composite conductor formed in the shape of a tape 33 is initially wrapped around a conductor spool 34, and a cloth 37 comprising an insulating material is wrapped around an insulation spool 38, both of which are mounted on an arm 35. The tension of the tape 33 and the cloth 37 are set by adjusting the tension brakes 39 to the desired settings. A typical value for the tensional force is between 1 - 5 lbs., although the amount can be adjusted for coils requiring different winding densities. The coil forming procedure is accomplished by guiding the eventual conducting and insulating materials onto the rotating material forming the central axis of the coil. Additional storage spools 36 are also mounted on the winding shaft 32 in order to store portions of the tape 33 intended to be wound after the initial portions of materials stored on spool 34 on the arm 35 have been wound onto the mandrel.

In order to form a coil 40, the mandrel 30 is placed on the winding shaft 32 next to storage spools 36 and the devices are rotated in a clockwise or counter-clockwise direction by the lathe chuck 31. In certain preferred embodiments of the invention, a "pancake" coil is formed by co-winding layers of the tape 33 and the cloth 37 onto the rotating mandrel 30. Subsequent layers of the tape 33 and cloth 37 are then co-wound directly on top of the preceding layers, forming a "pancake" coil having a height 41 equal the width of the tape 33. The "pancake" coil allows both edges of the entire length of tape to be exposed to the oxidizing environment during the heat treating step.

In other preferred embodiments of the invention, a double "pancake" coil may be formed by first mounting the mandrel 30 on the winding shaft 32 which is mounted in lathe chuck 31. A storage spool 36 is mounted on the winding shaft 32, and half of the total length of the tape 33 initially wrapped around spool 34 is wound onto the storage spool 36, resulting in the length of tape 33 being shared between the two spools. The spool 34 mounted to the arm 35 contains the first half of the length of tape 33, and the storage spool 36 containing the second half of the tape 33 is secured so that it does not rotate relative to mandrel 30. The cloth 37 wound on the insulation spool 38 is then mounted on the arm 35. The mandrel is then rotated, and the cloth 37 is co-wound onto the mandrel 30 with the first half of the tape 33 to form a single "pancake" coil. Thermocouple wire is wrapped around the first "pancake" coil in order to secure it to the mandrel. The winding shaft 32 is then removed from the lathe chuck 31, and the storage spool 36 containing the second half of the length of tape 33 is mounted on arm 35. A layer of insulating material is then placed against the first "pancake" coil, and the second half of the tape 33 and the cloth 37 are then co-wound on the mandrel 30 using the process described above. This results in the formation of a second "pancake" coil adjacent to the "pancake" coil formed initially, with a layer of insulating material separating the two coils. Thermocouple wire is then wrapped around the second "pancake" coil to support the coil structure during the final heat treatment. Voltage taps and thermo-couple wire can be attached at various points on the tape 33 of the double "pancake" coil in order to monitor the temperature and electrical behavior of the coil. In addition, all coils can be impregnated with epoxy after heat treating in order to improve insulation properties and hold the various layers firmly in place. The double "pancake" coil allows one edge of the entire length of tape to be exposed directly to the oxidizing environment during the final heat treating step.

In addition to providing oxygen access to the precursor to the superconducting material, the coil winding step can result in strengthening the matrix-forming material. Straining of silver, as well as other metals, during coil winding results in "strain hardening", a phenomenon which increases the ability of the metal to withstand an imparted stress. Because multi-filament composite conductors have metal regions surrounding the isolated superconducting regions, "strain hardening" strengthens the metal uniformly across the conductor cross section. This is not the case for mono-filament conductors, where the matrix-forming material surrounds the superconducting region in the core of the conductor, and "strain hardening" only strengthens the outer edges of the conductor.

Final Heat Treatment

After winding, the coil wound with the precursor to the multi-filament composite conductor is subjected to a final heat treating process, the general parameters of which have been described in detail (Riley et al., American Superconductor Corporation, "Improved Processing for Oxide Superconductors", S/N 08041822, U.S. Patent Pending). The final heat treating process of the present invention has been adapted to treat precursors to composite conductors wound into coils, and detailed descriptions of several final heat treating steps are included in the Examples described hereinafter.

The purpose of the final heat treatment is to convert the precursor to the composite conductor to the desired superconducting material, while at the same time heal micro-cracks and other defects incurred during winding. Typically, the final heat treatment involves heating the coil to a temperature in the range of 780 - 860 °C for a period of time substantially in the range of 0.1 hr. to 300 hr., typically in an oxidizing environment having a $pO_2$ in the range of 0.001 - 1.0 atm.

During the final heat treating step of the present invention, two central processing problems specific to wind-and-react coils formed with the precursors to multi-filament composite conductors must be overcome: 1) proper oxygen access must be provided for the precursor; and 2) "sagging" of the precursor, induced by weakening of the matrix-forming material during heating, must be compensated for. Because of the strict geometric tolerances required for coils, the processing environment must not decompose the insulating material or cause detrimental "sagging" in the matrix-forming material.

The oxygen-access requirements for the precursors to multi- and mono-filament composite conductors differ because of the distribution of the superconducting precursor material in the composite. The increase in the relative surface area of the interfacial regions in the multi-filament composite conductor allows for improved oxygen access to the oxide precursor during the heat treating step. As discussed in Okada et al., U.S. Patent No. 5,063,200, the diffusivity of oxygen is much higher in a matrix-forming material made of silver than in the superconducting regions. The increase in the surface area of interfacial regions in the multi-filament composite conductor results in better exposure of the superconducting regions to oxygen, resulting in the optimization of the electrical properties of the superconducting oxide.

As discussed herein, oxygen access can be increased to the precursor of the superconducting material by using a ceramic insulation material having a suitable thickness. Oxygen access can also be increased by modifying the geometry of the coil in the furnace. To provide sufficient oxygen access, "pancake" or double "pancake" coils can be wound as described above. During the heat treating step, the coil can be placed on a oxygen-porous, honeycomb mantle to provide increased oxygen access to the coil during processing.

The presence of the mandrel also has to be accounted for in the wind-and-react process. The mandrel can become oxidized, and can also block oxygen access to the conductor. In a particular embodiment of the invention, the mandrel is made of silver, which is oxygen permeable at high temperatures, and thus allows increased exposure of the precursor to the multi-filament conductor to oxygen during processing. Furthermore, a mandrel composed of the same material as the matrix-forming material (ie., silver) will exhibit the same thermal expansion and contraction properties, thus reducing strain incurred during heating and cooling steps of the processing method.

The ability of the precursor to the multi-filament composite to undergo improved crack healing during the final heat treating step is also improved relative to mono-filament composites due to the increase in the superconductor/matrix-forming material interfacial regions. Because the surface-to-volume ratio of the superconducting region increases as the sizes of the individual regions are decreased, multi-filament composites will necessarily have an increased amount of interfacial regions when compared to mono-filament composites having the same fill factor. Successful crack healing depends on partial melting of the superconducting regions during processing, which leads to coexisting liquid and solid oxide phases of the superconducting material. Recrystallization back into the superconducting oxide phase results in crack healing. It is well known in the art that the presence of silver lowers the melting point of the superconducting precursor material. This effect will therefore be more prominent in multi-filament composite conductors because of the increased surface area of interfacial regions.

In addition, the thermal conductivity of the silver matrix-forming material is significantly higher than that of the superconducting precursor material. The thermal gradient across the superconducting regions during processing will therefore be increased as the cross-sectional size of the region is increased. The decrease in size of the superconducting regions in the multi-filament composite conductors results in a more uniform heating field being applied to the superconducting material because of the increased interfacial region. This results in partial melting of the superconducting region of the multi-filament composite conductor occurring at a lower temperature and being more uniform than for mono-filament composite conductors.

When heated to the high temperatures of the final heat treating step, silver does not melt but is essentially left without strength. A conductor wound in a coil geometry can therefore "sag", or deform under its own weight, resulting in a decrease in the winding density. Furthermore, the complex winding densities used to provide the coil with sufficient oxygen access are more likely to expose the multi-filament composite conductor to non-uniform temperature distributions, resulting in unpredictable "sagging" of the composite conductor during heating. These problems are overcome by using a thermocouple wire, or other heat-resitant wire, to restrain the layers of insulated composite precursor during heat treatment. Coils can also be mounted with their central axis vertical in order to reduce the effects of "sagging".

Once the superconducting state is achieved, critical-current densities in the conductor are strongly dependent on filament thickness, conductor thickness, and filament position within the conductor. Filament thickness is typically on the order of 17 μm, and overall conductor thickness is typically 175 μm. Multi-filament composite conductors used in superconducting magnetic coils processed with the wind-and-react method can typically exhibit critical-current values between about 1 - 20 Amperes at 77 $^{o}$K in self field, depending on the number of conductors surrounded by a single insulating layer. The values of the critical-current is particularly sensitive to the magnetic field perpendicular to the wide portion of the conductor surface.

Electro-Mechanical Properties of Multi-filament Composite Conductors Processed with the Wind-and-React Method

Multi-filament composite conductors processed with the method of the present invention have higher strain tolerances than mono-filament composite conductors due to the strain-dependent properties of the superconducting regions and the matrix-forming material. For most superconducting materials, the critical current is independent of the amount of tensile strain (that is, strain associated with the tension of the conductor) unless the critical strain of the material is exceeded. When this occurs, the thickness of the induced micro-cracks is proportional to the tensile strain, and the maximum critical-current value supported by the superconductor is decreased significantly. This relationship between critical-current and tensile strain is illustrated in Figure 6 for a sample of multi-filament composite conductor 15 cm in length and cut from one end of a 70 m long conductor. The critical-strain for this particular sample is about 0.54%. At strains exceeding the critical-strain value of the conductor, the critical-current decreases asymptotically towards about 2 $kA/cm^2$. If the local tensile strain is significantly greater than the critical strain value of the precursor to the conducting material, micro-crack formation can occur to such an extent that crack healing becomes impossible. Because critical strain values are typically much greater for multi-filament composite conductors compared to mono-filament composite conductors, it is possible to subject the superconducting region to higher tensional strains during coil winding without the conductor incurring irreparable damage.

A decrease in critical-current density for both multi- and mono-filament composite conductors can also occur when the current generating the magnetic field rapidly increases or decreases, or otherwise oscillates with time.

In general, losses due to alternating currents in conductors can be reduced by subdivision of the superconducting regions, and will therefore be less severe for multi-filament composite conductors. A detailed discussion of this phenomenon can be found in M.N. Wilson, Superconducting Magnets, Monographs on Cryogenics, Clarendon Press, Oxford, 1983.

Referring now to Figure 7, another advantage of the processing method in accordance with the present invention is illustrated by the graph which plots critical-current densities measured in BSCCO (2223) composite conductors as a function of bend strain. The critical strain values of the conductors were in the range of 0.3 - 0.5%. In the experiment, bend strain, normally incurred through winding, was simulated by bending composite conductors to various radii. After the bending, conductors were exposed to a sintering step. Following heating, the current density was measured across the bent section of the conductor.

The insensitivity and high value of the critical-current density supported by the conductor in the presence of bend strains in excess of the critical strain of the conductor clearly demonstrates the crack healing ability of a multi-filament composite conductor. Although critical-current density initially decreases by about 10% for small bend strains (from comparison with the critical-current value of about 11.2 x $10^3$ A/$cm^2$ at zero bend strain), the critical-current density is relatively insensitive to values of bend strain up to nearly 5%. For a conductor thickness of 175 μm, a 5% bend strain corresponds to a bend radius of about 1.6 mm.

Referring now to Figure 8, further benefits of wind-and-react processing of multi-filament composite conductors are illustrated by comparing the normalized critical-current density as a function of bend strain for multi-filament composite BSCCO (2223) conductors processed with different methods. Conductors processed with the wind-and-react processing method were first bent and then subjected to a final heat treating step, while the react-and-wind processing conditions comprised heat treating the conductor, inducing the desired bend strain, and finally measuring the current density across the bent section of the conductors.

At 1% bend strain, the critical-current density supported by the conductor treated under the react-and-wind processing conditions is reduced to 43% of its maximum value (measured at 0% bend strain). In comparison, at 1% bend strain, the critical-current density supported by the conductor treated under the wind-and-react processing conditions is minimally reduced to 85% of its maximum value, indicating the advantage of the processing method of the present invention.

Variations of Wind-and-React Coils

In commercial applications, the success of the wind-and-react processing method is dependent on the influence of the processing environment on the superconducting material. Principally, two factors contribute to this influence: 1) the susceptibility of the precursor of the eventual superconducting material to temperature during the sintering steps; and, 2) the permeability of silver to oxygen at temperatures in excess of 800°C. The first factor allows successful micro-crack healing by melting and recrystallizing the superconducting grains during the sintering (and the subsequent cooling) steps of the inventive method, and the second factor permits exposure of the precursor to the multi-filament composite conductor to oxygen, which facilitates micro-structural growth of the superconducting grains. Both factors will be influenced by the design and physical dimensions of the various coil types.

Because the coil is subjected to a final heat treating process, the design tolerances are of particular importance. The multi-filament composite conductors used to form the coils must have the length and width dimensions kept as uniform as possible. If multiple coils are to be stacked, it is important to fabricate coils having uniform geometric sizes, and to minimize deformation during the heat treating process. This ultimately results in final coil designs having high winding and packing densities, which are critical in determining the resultant magnetic field.

Referring now to Figure 9, a layer-wound solenoid superconducting coil 50 processed by the wind-and-react method of the present invention has a mandrel 53 wrapped by a multi-filament composite conductor 51, which has a ceramic insulation covering 52 wrapped around it. The designs and thermal properties of the superconducting coil 50 and mandrel 53 have substantial influences on the heating and oxygenation of the superconducting material encased in the multi-filament composite conductor 51. For example, if the heat capacity of the mandrel 53 is large, the temperature cooling rates of the heat treating steps of the present processing method may have to be increased in order for the coil to thermally equilibrate at low temperatures in the required amount of time. Similarly, the amount of heat transferred from mandrel 53 to the multi-filament composite conductor 51 will be dependent on the size of the mandrel, with larger mandrels dissipating more heat to the surrounding conductor than smaller mandrels.

Referring now to Figures 10 and 10a, a preferred embodiment of the "pancake" superconducting magnetic coil 67 wound with multi-filament composite conductor 66 is shown. To ensure that the multi-filament composite conductor 66 receives acceptable exposure to oxygen during the final sintering step of the wind-and-react process, the precursor to the multi-filament composite conductor, which has a flattened ribbon or tape configuration, is wrapped in layers concentrically around a mandrel 65 forming a spiral pattern. Each layer is wound directly on top of the preceding inner layer, making the height h of the coil 67 equal to the width of tape. Figure 10a shows a top view of the illustrated embodiment of the conductor in Figure 10, and illustrates how the outer edge of the precursor to the composite conductor is exposed to the oxygen atmosphere along its entire length during the heat treating step of the wind-and-react processing method.

The "pancake" coil 67 is desirable because it provides a configuration in which the multi-filament composite conductor 66 has a high winding density, while maintaining suitable oxygen exposure for the multi-filament composite conductor 66 during the final heat treatment step. In an embodiment of the present invention, approximately 20 layers of the precursor to the multi-filament composite conductor are used to wrap the mandrel 65, with the total length used being about 100 cm. Using a BSCCO (2223) conductor with 19 filaments, the illustrated embodiment of the invention is capable of supporting a current of about 15 Amperes at 77 K, with an associated magnetic field being as large as about 100 Gauss. This coil is expected to perform at a higher level than a coil having a layer-wound configuration (Figure 9) treated with the wind-and-react processing method. For this latter case, only the outer surface of the winding is exposed to the oxidizing atmosphere during final processing, and the electrical properties of the conducting material are thus expected to be inferior.

In an alternate embodiment of the present invention, free-standing "pancake" coils can be fabricated by removing the mandrel from the center of the coil. This embodiment can be desirable because elimination of the mandrel results in reduced cycling stress which results from thermal expansion of the mandrel during heating and cooling steps.

Referring now to Figure 10b, in another alternate embodiment of the present invention, the "pancake" coil can be formed around a mandrel having a cross section with a primarily elliptical, "racetrack" shape, rather than the circular cross section of the "pancake" coil illustrated in Figure 10a. In other alternate embodiments of the present invention, mandrels having arbitrary shapes and sizes can be used to support the multi-filament composite conductor.

In another preferred embodiment of the invention, double "pancake" coils having circular or primarily elliptical ("racetrack") shaped cross sections can be formed using the winding process described herein. This coil geometry comprises two adjacent single "pancake" coils wound from a single tape comprising the precursor to a multi-filament composite conductor, with the adjacent coils sharing the same central axis. In this geometry, each end of the tape forming the two coils is on the outer surface of the coil, thereby eliminating electrical connections inside the coils.

In another alternate embodiment of the invention, the winding density of the coil may be increased by co-winding two or more portions of tape comprising the precursor to the multi-filament composite conductors together with a single cloth comprising the precursor to an insulating material, and then forming the cloth and tape into a single or double "pancake" (or "racetrack") coil. Co-winding multiple strands of conductor in this fashion is effectively the same as wiring multiple conductors in parallel, and coils formed in this manner can achieve even higher winding densities while minimizing the amount of insulation in the coil.

Referring now to Figure 11, which shows a side view of another preferred embodiment of the invention, and Figure 11a, which shows a cross-sectional view of the same embodiment, a mechanically robust, high-performance superconducting coil assembly 70 combines multiple double "pancake" coils 71 each having co-wound multi-filament composite conductors. In the coil assembly 70, double "pancake" coils 71 having four co-wound conductors wound in parallel are stacked coaxially on top of each other, with adjacent coils separated by a layer of ceramic insulation 72. A tubular mandrel 74 supports the coils 71. End flange 77 is welded to the top of the tubular mandrel 74, and end flange 76 threads onto the opposite end of the tubular mandrel 74 in order to compress the double "pancake" coils 71. In an alternate embodiment, the tubular mandrel 74 and the two end flanges can be removed to form a free-standing coil assembly.

A segment of superconducting material 78 is used to connect the double "pancake" coil adjacent to end flange 76 to termination post 79 located on end flange 77. Individual coils are connected in series with short segments of superconducting material, and an additional length of superconducting material 82 connects the double "pancake" coil adjacent to end flange 77 to termination post 81. These electrical connections allow current to flow from termination post 81, through the individual coils, to termination post 79. The current is assumed to flow in a counter-clockwise direction, and the magnetic field vector 80 is normal to the end flange 77 forming the top of coil assembly 70.

A particular advantage of coils featuring multi-filament composite conductors is related to the thermal fatigue incurred through heating and cooling the coil, and is illustrated by the plot in Figure 3. The Figure plots the retention of critical-current for composite conductors (wound into coils) as a function of thermal cycles, which are defined as the processes of cooling the coil down to cryogenic temperatures and then heating the coil back to room temperature. Due to the inherent lack of flexibility of the mono-filament composite conductor, the coil performance is decreased severely after 5 thermal cycles, with the critical-current retention dropping to 10% of its maximum value. In contrast, the coil wound with multi-filament composite conductor shows no significant decrease in coil performance after 5 thermal cycles, with the critical-current density retaining greater than 95% of its maximum value.

Examples

The following Examples are used to describe the wind-and-react processing method of the present invention.

Example 1 - Layer-Wound Solenoid Coil

The precursor to the superconducting phase of BSCCO (2223) was packed into a silver tube having an inner diameter of 1.59 cm, a length of 13.97 cm, and a wall thickness of 0.38 cm to form a billet. A wire was then formed by initially extruding the billet to a diameter of 0.63 cm, with subsequent drawing steps reducing the wire cross section to a hexagonal shape 0.18 cm in width. Nineteen similar wires were then bundled together and drawn through a round die having a diameter of 0.18 cm to form a precursor to a multi-filament composite conductor having a circular cross section. The precursor was then rolled to form a multi-filament composite tape 30 m in length having a rectangular (0.25 cm x 0.03 cm) cross section. A single layer of Nextel ceramic fiber having a thickness of 0.002 cm was braided around the multi-filament composite tape prior to the final sintering.

The layer-wound solenoid coil was formed by winding the insulated multi-filament composite tape around a cylindrical mandrel having height of 3.00 cm and a diameter of 1.27 cm. Two circular flanges, each having a diameter of 6.01 cm, were welded to each face of the mandrel. Both the mandrel and circular flanges were composed of Haynes 214, a nickel-based alloy. Radial slots were cut into each flange to promote oxygen access to the multi-filament composite tape during the final heat treating process.

A section of composite tape was then wound once around the perimeter of the mandrel, creating a bend strain of about 6% in the conductor precursor. A layer of thermocouple wire was wrapped around the composite tape, thus securing it to the mandrel. Two silver foil electrical terminations were connected to the initial segments of the multi-filament composite tape to form the current and voltage leads. A single layer of the multi-filament composite tape was then wound helically along the length of the mandrel. The winding process was repeated using the remaining portions of the composite tape, resulting in 30 layers being wound onto the mandrel. The final segment of the composite tape was secured to the mandrel with thermocouple wire, and electrical leads were attached as described above.

The superconducting phase of the multi-filament composite tape was formed by processing the solenoid coil with a final heat treating step comprising the steps of: 1) heating the coil from room temperature at a rate of 1 $^{o}$C/min to a temperature of 820 $^{o}$C in 0.075 atm $O_2$; 2) heating the coil at 820 $^{o}$C for 54 hours; 3) cooling the coil to 810 $^{o}$C and holding for 30 hours; and 4) allowing the coil to cool to room temperature in 1 atm $O_2$.

Electrical properties of the coil were monitored using the voltage and current leads attached to the initial and final segments of the insulated multi-filament composite conductor. The critical current of the coil at 77 $^{o}$K was measured to be 1.6 Amperes, with the magnetic field in the center of the coil calculated to be 150 Gauss.

Example 2 - "Pancake" Coil

The precursor to the multi-filament composite conductor was formed using the deformation and rebundling processes described in Example 1, and then rolled to form a 2.7 m long multi-filament composite tape having a thickness of 0.02 cm and a width of 0.25 cm. A Nextel ceramic fiber having an adhesive binder was braided around the composite tape prior to coil formation.

A single layer of composite tape was then wound onto a mandrel made from Haynes 214 alloy and having a bore diameter of 1.25 cm, creating a bend strain in the multi-filament composite tape similar to the value described in the previous Example. Thermocouple wire and electrical terminations (voltage and current leads) were attached to the initial layer of composite tape as described in Example 1. A 28-layer "pancake" coil having an outer diameter of 6.73 cm was formed by winding the remaining length of the multi-filament composite tape onto the mandrel, with each successive turn forming a layer of composite tape directly on top of the previous layer. Electrical terminations and thermocouple wire were attached to the outer layer of the multi-filament composite tape as described in Example 1. Following the winding process, the "pancake" coil was subjected to two separate heat treating processes. The initial process was used to remove the adhesive binder from the Nextel ceramic fiber insulating layer, and comprised the steps of: 1) heating the coil from room temperature to 550 °C at a rate of 5 °C/min; 2) heating the coil at 550 °C for 15 hours; and 3) allowing the coil to cool to room temperature. The formation of the superconducting phase in the insulated composite tape was accomplished with a final heat treating step, comprising the steps of: 1) heating the coil from room temperature to 890 °C at a rate of 10 °C/min in 0.75 atm $O_2$; 2) immediately cooling the coil at a rate of 10 °C/min to 810 °C; 3) heating the coil at 810 °C for 100 hours; 4) cooling the coil at a rate of 10 °C/min to 700 °C; and 5) allowing the coil to cool to room temperature.

Electrical properties of the "pancake" coil were monitored using the voltage and current leads attached to the initial and final layers of the coil. The critical current of the coil at 77 °K was measured to be 1.35 Amperes, with the magnetic field in the center of the coil calculated to be 85 Gauss.

Example 3 - Double "Pancake" Coil

The multi-filament composite tape was formed using the deformation and rebundling processes described in Example 2. Four different sections of multi-filament composite tape and a section of quartz cloth were then wound onto five separate spools, each of which was mounted on the arm of the coil winding device shown in Figure 5.

Using the double "pancake" winding procedure described previously, portions of the four sections of multi-filament composite tape were then co-wound with the quartz cloth onto a mandrel made of silver and having an internal diameter of 2.86 cm. A single layer of the coil thus comprised four portions of composite tape wound on top of each other, with a single portion of quartz cloth wound on top of the forth layer. The bend strain of the composite tape in the first layer of the coil was estimated to be 0.50%. The co-winding procedure for the double "pancake" coil was repeated to form two "pancake" coils, each having 55 layers, with the coils separated by a thin insulating sheet comprising quartz fibers. The final outer diameter of the double "pancake" coil was approximately 10.8 cm.

The binder was removed from the insulation layer using the initial heat treating process described above. The formation of the superconducting phase in the insulated multi-filament composite tape sections of the double "pancake" coil was accomplished with a final heat treating step comprising the steps of: 1) heating the coil at a temperature of 20 °C for 1 hour; 2) increasing the temperature at a rate of 10 °C/min to 789 °C; 3) increasing the temperature at a rate of 1 °C/min to 830 °C; 4) heating the coil at 830 °C for 40 hours; 5) cooling the coil at a rate of 1 °C/min to 811 °C; 6) heating the coil at 811 °C for 120 hours; 7) cooling the coil at a rate of 5 °C/min to 787 °C; 8) heating the coil at 787 °C for 30 hours; and, 9) cooling the coil at rate of 5 °C/min to cool to room temperature. The atmosphere was comprised of 7.5% $O_2$ for all steps of the final heat treating step. Following the processing steps, the mandrel was removed and the double "pancake" coil was impregnated with epoxy in order to hold the layers of insulation and composite tape firmly in place.

Electrical properties of the double "pancake" coil were monitored using the voltage and current leads attached to the ends of the superconducting composite tape located on the outside surface of each "pancake" coil. The critical current of the coil at 77 °K was measured to be 18.9 Amperes, with the self field calculated to be 250 Gauss.

Example 4 - Stacked Double "Pancake" Coils

Eight double "pancake" coils were individually fabricated and heat treated as described in Example 3. After removing each of the mandrels, the coils were then co-axially stacked on top of each other and supported by an aluminum tube having a height of 7.60 cm and a diameter of 2.86 cm which was placed through the center of the coils. An aluminum flange was welded to the top of the tube, and another flange was threaded to the bottom section of the tube in order to compress the pancake coils together. Termination posts were attached to the top portion of the end flange in order to monitor the current and voltage values of the coil.

In order to join individual coils together in a series circuit, electrical connections consisting of short lengths of multi-filament composite tape containing superconducting BSCCO (2223) were soldered to the ends of the composite tape located on the outside surface of each double "pancake" coil. Similar lengths of multi-filament composite tape were used to make current leads from the termination post to the coil. Resistive losses due to the soldered electrical terminations used to connect the coils in series were measured to be in the $\mu\Omega$ regime. The critical current density of the stacked coils was similar to the value measured in Example 3, and the calculated field in the center of the coil was approximately 4,000 Gauss at 77 $^{o}$K.

The foregoing descriptions of preferred embodiments of the processing methods and related inventions have been presented for purposes of illustration and description. They are not intended to be exhaustive or to limit the invention to the precise form disclosed. The embodiments chosen are described in order to best explain the principles of the processing method and invention.

1. A method for producing a superconducting magnetic coil comprising the steps of:

fabricating the precursor to a multi-filament composite conductor comprising multiple superconductor precursor filaments enclosed in a matrix-forming material, surrounding said precursor to said multi-filament composite conductor with one of an insulating layer and a precursor to an insulating layer, forming said precursor to said multi-filament composite conductor as a coil, heat treating said coil after said forming step by exposing said coil to high temperatures and an environment comprising oxygen, said superconductor precursor filaments being oxidized and said matrix-forming material reversibly weakening during said heat treating step, the composition and thickness of one of said insulating layer and said precursor to said insulating layer chosen to encase said weakened matrix-forming material and said superconductor precursor filaments and to permit exposure of said superconductor precursor filaments to oxygen during said heat treating step, said heat treating step resulting in the improvement of the electrical and mechanical properties of said superconductor precursor filaments, and in the formation of a superconducting magnetic coil.

2. The method of claim 1, wherein said step of heat treating comprises the steps of:

heating and cooling said coil in an environment comprising oxygen, said heat treating step resulting in the conversion of said superconductor precursor filaments to a desired superconducting material and in the repair of micro-cracks formed in said filaments during said forming step.

3. The method of claim 2, wherein said step of heat treating comprises the steps of:

heating said coil at a rate of about 10 °C/min until a temperature between 765 °C and 815 °C is obtained, heating said coil at a rate of about 1 °C/min until a maximum temperature between 810 °C and 860 °C is obtained, heating said coil at said maximum temperature between 810 °C and 860 °C for a time period between 0.1 and 300 hours, cooling said coil at a rate of about 1 °C/min. until a temperature between 780 °C and 845 °C is obtained, heating said coil at said temperature between 780 °C and 845 °C for a time period in the range of 1 to 300 hours, cooling said coil at a rate of about 5 °C/min. until a temperature between 765 °C and 815 °C is obtained, heating said coil at said temperature between 765 °C and 815 °C for a time period in the range of 1 to 300 hours, cooling said coil at a rate of about 5 °C/min. until a temperature of about 20 °C is obtained, said heat treating step being performed in said environment comprising oxygen, wherein the pressure of said oxygen is between about 0.001 and 1.0 atm.

4. The method of claim 2, wherein said step of heat treating comprises the steps of:

heating said coil at a rate of 10 °C/min. until a temperature of 789 °C is obtained, heating said coil at a rate of 1 °C/min. until a maximum temperature of 830 °C is obtained, heating said coil at said maximum temperature of 830 °C for a time period of 40 hours, cooling said coil at a rate of 1 °C/min until a temperature of 811 °C is obtained, heating said coil at said temperature of 811 °C for a time period of 120 hours, cooling said coil at a rate of 5 °C/min. until a temperature of 787 °C is obtained, heating said coil at said temperature of 787 °C for a time period of 30 hours, cooling said coil at a rate of 5 °C/min. until a temperature of 20 °C is obtained, said heat treating step being performed in said environment comprising oxygen, wherein the pressure of said oxygen is 0.075 atm.

5. The method of claim 1, wherein said surrounding step comprises the steps of:

immersing said precursor to said multi-filament composite conductor in a liquid mixture, of one of a solvent and/or dispersant, and a particulate material comprising the precursor to an insulating material, and then removing said precursor to said multi-filament composite conductor from said liquid mixture, heating said precursor to said multi-filament composite conductor after said immersing and removing steps, said heating resulting in the evaporation of said solvent and/or dispersant, and resulting in the formation of an insulating layer around said precursor to said multi-filament composite conductor.

6. The method of claim 1, wherein said surrounding step comprises the steps of:

wrapping an insulating material around said precursor to said multi-filament composite conductor, heating said precursor to said multi-filament composite conductor after said wrapping step, said heating resulting in the removal of impurities from said insulating material.

7. A method for producing a superconducting magnetic coil, comprising the steps of:

winding one layer of a precursor to a multi-filament composite conductor comprising multiple superconductor precursor filaments enclosed in a matrix-forming material around a mandrel to form a precursor layer, winding one layer of a material comprising one of an insulating material and a precursor to an insulating material on top of said precursor layer to form a composite layer, forming a plurality of said composite layers by repeating said winding steps, said plurality of composite layers forming said coil, heat treating said coil after said forming step by exposing said coil to high temperatures and an environment comprising oxygen, said superconductor precursor filaments being oxidized and said matrix-forming material reversibly weakening during said heat treating step, 20 the composition and thickness of one of said
21 insulating material and said precursor to said insulating
22 material chosen to encase said weakened matrix-forming
23 material and said superconductor precursor filaments, and to
24 permit exposure of said superconductor precursor filaments
25 to oxygen during said heat treating step,
26 said heat treating step resulting in the improvement
27 of the electrical and mechanical properties of said
28 superconductor precursor filaments, and in the formation of
29 a superconducting magnetic coil.

1 8. The method of claim 7, wherein said coil forming
2 step comprises the steps of:
3 concentrically winding said composite layers around
4 a mandrel, forming a multi-layer, insulated "pancake"-shaped
5 coil,
6 each of said layers of said coil being wound to
7 directly overlap the preceding layer to form said "pancake"-
8 shaped coil,
9 said "pancake"-shaped coil permitting exposure of an
10 edge of the entire length of said precursor to said multi-
11 filament composite conductor to a selected oxidizing
12 atmosphere during a heat treating step,
13 said heat treating step resulting in the conversion
14 of said superconductor precursor filaments to a desired 15 superconducting material and in the repair of micro-cracks
16 formed in said filaments during said forming step.

1 9. The method of claim 8, wherein each composite
2 layer comprises multiple precursor layers surrounded by a
3 single layer of one of an insulating material and a
4 precursor to an insulating material.

1 10. The method of claim 8, further comprising the
2 step of winding a second "pancake"-shaped coil on said
3 mandrel adjacent to said "pancake"-shaped coil, forming a
4 double "pancake"-shaped coil.

1 11. The method of claim 10, wherein said double
2 "pancake"-shaped coil is formed by the steps of:
3 winding said precursor to said multi-filament
4 composite conductor around a supply spool,
5 winding a portion of the length of said precursor to
6 said multi-filament composite conductor wound around said
7 supply spool onto a storage spool,
8 concentrically winding the remaining portion of said
9 precursor to said multi-filament composite conductor wound
10 around said supply spool and one of said insulating material
11 and said precursor to said insulating material onto a
12 mandrel to form a composite layer, 13 forming a plurality of said composite layers,
14 each of said composite layers being wound to
15 directly overlap the preceding layer to form a first
16 "pancake"-shaped coil,
17 winding a second "pancake"-shaped coil onto said
18 mandrel using said portion of the length of said precursor
19 to said multi-filament composite conductor wound onto said
20 storage spool and one of an insulating material and a
21 precursor to said insulating material.

1 12. The method of claim 8, wherein said cross
2 section of said mandrel has an arbitrary shape.

1 13. The method of claim 8, wherein said cross
2 section of said mandrel is primarily circular in shape.

1 14. The method of claim 8, wherein said cross
2 section of said mandrel is primarily elliptical in shape.

1 15. The method of claim 10 further comprising the
2 step of combining multiple double "pancake"-shaped coils.

1 16. The method of claim 15 further comprising the
2 step of coaxially stacking said multiple double "pancake"-
3 shaped coils.

17. A method for producing a superconducting magnetic coil comprising the steps of:

fabricating the precursor to a multi-filament composite conductor comprising multiple superconductor precursor filaments enclosed in a matrix-forming material, surrounding said precursor to said multi-filament conductor with one of an insulating layer and a precursor to an insulating layer, forming said precursor to said multi-filament composite conductor as a coil, heat treating said coil after said forming step by exposing said coil to high temperatures and an environment comprising oxygen, said superconductor precursor filaments being oxidized and said matrix-forming material reversibly weakening during said heat treating step, the composition and thickness of one of said insulating layer and said precursor to said insulating layer chosen to encase said weakened matrix-forming material and said superconductor precursor filaments and to permit exposure of said superconductor precursor filaments to oxygen during said heat treating step, said heat treating step resulting in the formation of a multi-filament composite conductor from said precursor to said multi-filament composite conductor, said multi-filament composite conductor formed into said coil being subjected to a bend strain in excess of the critical strain of said multi-filament composite conductor, said coil, after said heat treating step, having a minimum critical-current of about 1.2 Amperes.

18. The method of claim 17, wherein said forming step comprises the step of subjecting said multi-filament composite conductor to a bend strain in excess of about 0.3%.

19. A superconducting magnetic coil made by the method of claim 1.

20. A superconducting magnetic coil comprising:

a multi-layer coil of a multi-filament composite conductor comprising multiple superconducting filaments enclosed in a matrix-forming material, said multi-filament composite conductor formed into said multi-layer coil being subjected to a bend strain in excess of the critical strain of said multi-filament composite conductor, said multi-filament composite conductor having a minimum critical-current of 1.2 Amperes.

21. The superconducting magnetic coil of claim 20, wherein said multi-filament composite conductor is surrounded by an insulating layer.

22. The superconducting magnetic coil of claim 21, wherein said insulating layer comprises an insulating material permeable to gaseous oxygen and substantially chemically inert relative to said multi-filament composite conductor.

23. The superconducting magnetic coil of claim 22, wherein said insulating material comprises ceramic fibers.

24. The superconducting magnetic coil of claim 23, wherein said ceramic fibers are composed primarily of ceramic materials selected from the group comprising $SiO_2$, $Al_2O_3$, and zirconia.

25. The superconducting magnetic coil of claim 24, wherein said insulating material has a thickness between 10 and 150 $\mu$m.

26. The superconducting magnetic coil of claim 22, wherein said insulating material comprises a particulate material.

27. The superconducting magnetic coil of claim 26, wherein said particulate material is a ceramic material selected from a group comprising $Al_2O_3$, MgO, $SiO_2$, and zirconia.

28. The superconducting magnetic coil of claim 27, wherein the thickness of said insulating layer is between 10 and 150 $\mu$m.

29. The superconducting magnetic coil of claim 20, wherein each layer of said coil comprises multiple multi-filament composite conductors, said multiple multi-filament composite conductors surrounded by a single insulating layer.

30. The superconducting magnetic coil of claim 20 wherein said matrix-forming material is selected from a group comprising a noble metal and an alloy of a noble metal.

31. The superconducting magnetic coil of claim 30, wherein said noble metal is silver.

32. The superconducting magnetic coil of claim 20, wherein said superconducting filaments are comprised of materials selected from the oxide superconducting family.

33. The superconducting magnetic coil of claim 32, wherein said superconducting filaments are composed primarily of the three-layer phase of BSCCO.

34. The superconducting magnetic coil of claim 20, wherein said coil is impregnated with a polymer.

35. A superconducting magnetic coil, comprising:

a coil of multi-filament composite conductors comprising multiple superconducting filaments enclosed in a matrix-forming material, the bend strain of said multi-filament composite conductors being greater than about 0.3%.

36. A superconducting magnetic coil, comprising:

a coil of multi-filament composite conductors comprising multiple superconducting filaments enclosed in a matrix-forming material, said multi-filament composite conductors wound to form said coil, the inner-diameter of said coil being no larger than about 1 cm.

37. A superconducting magnetic coil, comprising:

a coil of multi-filament composite conductors comprising multiple superconducting filaments enclosed in a matrix-forming material, said multi-filament composite conductors wound to form said coil, the winding density of said coil being greater than about 60%.

38. A superconducting magnetic coil, comprising:

a coil of multi-filament composite conductors having multiple superconducting filaments enclosed in a matrix-forming material, the bend strain of said multi-filament composite conductors being greater than about 0.3%, said multi-filament composite conductors having a fill factor greater than about 30%.

39. A superconducting magnetic coil, comprising:

a coil of multi-filament composite conductors having multiple superconducting filaments enclosed in a matrix-forming material, the bend strain of said multi-filament composite conductors being greater than about 0.3%, said coil producing a magnetic field in excess of about 80 Gauss.

40. A superconducting magnetic coil, comprising:

a coil of multi-filament composite conductors having multiple superconducting filaments enclosed in a matrix-forming material, the bend strain of said multi-filament composite conductors being greater than about 0.3%, the winding density of said coil being greater than about 60%, said multi-filament composite conductors having a fill factor greater than about 30%, and, said coil producing a magnetic field in excess of about 80 Gauss.

41. A superconducting magnetic coil, comprising:

a coil of multi-filament composite conductors having multiple superconducting filaments enclosed in a matrix-forming material and surrounded with an insulating layer to form an insulated multi-filament composite conductor, said multi-filament composite conductors and said insulation layers being located concentrically around a mandrel to form a single-width, multiple-layer coil of a continuous length of said insulated multi-filament composite conductor, each of said layers of said insulated multi-filament composite conductor being located directly over the preceding layer, forming a "pancake"-shaped coil, said "pancake"-shaped coil permitting exposure of an edge of the entire length of said wound insulated multi-filament composite conductor to a selected oxidizing atmosphere during a heat treating step.

42. The superconducting magnetic coil of claim 41, wherein each layer of said insulated multi-filament composite conductor forming said coil consists of multiple multi-filament composite conductors, said multiple multi-filament composite conductors being surrounded by a single insulating layer.

43. The superconducting magnetic coil of claim 41, wherein said matrix-forming material is selected from a group comprising a noble metal and an alloy of a noble metal.

44. The superconducting magnetic coil of claim 43, wherein said noble metal is silver.

45. The superconducting magnetic coil of claim 41, wherein said superconducting filaments are comprised of materials selected from the oxide superconductor family.

46. The superconducting magnetic coil of claim 45, wherein said superconducting filaments are composed primarily of the three-layer phase of BSCCO.

47. The superconducting magnetic coil of claim 41, wherein said insulating layer comprises an insulating material permeable to gaseous oxygen and substantially chemically inert relative to said multi-filament composite conductor.

48. The superconducting magnetic coil of claim 47, wherein said insulating material comprises ceramic fibers.

49. The superconducting magnetic coil of claim 48, wherein said ceramic fibers are composed primarily of a ceramic material selected from the group comprising $SiO_2$, $Al_2O_3$, and zirconia.

50. The superconducting magnetic coil of claim 49, wherein said insulating material has a thickness between 10 and 150 $\mu$m.

51. The superconducting magnetic coil of claim 47, wherein said insulating layer comprises a particulate material.

52. The superconducting magnetic coil of claim 51, wherein said particulate material is a ceramic material selected from a group comprising $Al_2O_3$, MgO, $SiO_2$, and zirconia.

53. The superconducting magnetic coil of claim 52, wherein the thickness of said insulating layer is between 10 and 150 $\mu$m.

54. The superconducting magnetic coil of claim 41, wherein said cross section of said mandrel has an arbitrary shape.

55. The superconducting magnetic coil of claim 41, wherein said cross section of said mandrel is primarily circular in shape.

56. The superconducting magnetic coil of claim 41, wherein said cross section of said mandrel is primarily elliptical in shape.

57. The superconducting magnetic coil of claim 41, wherein said mandrel is composed primarily of silver.

58. The superconducting magnetic coil of claim 41, wherein said coil is impregnated with a polymer.

59. The superconducting magnetic coil of claim 41, wherein a second "pancake"-shaped coil is wound on said mandrel adjacent to said "pancake"-shaped coil, forming a double "pancake"-shaped coil.

60. The superconducting magnetic coil of claim 59, further comprising a plurality of said double "pancake"-shaped coils stacked coaxially and adjacent to each other with groups of at least one of said double "pancake"-shaped coils being separated from each other by an insulating material.

61. The superconducting magnetic coil of claim 60, wherein said mandrel is removed.

What is claimed is:

1. A method for providing a magnetic coil comprising a plurality of sections positioned axially along the axis, each section being formed of a preselected high temperature superconductor material wound about a longitudinal axis of the coil and having an associated critical current value, each section contributing to the overall magnetic field of the coil, the method comprising the steps of:

a) providing a plurality of sections of high temperature superconducting material;

b) positioning the sections along the axis of the coil to provide a substantially uniform distribution of superconductor material along the axis of the coil;

c) determining critical current characteristic data for each of the sections on the basis of the preselected high temperature superconductor material associated with each section and the magnitude and angle of an applied magnetic field in which the superconductor material is disposed;

d) determining a distribution of magnetic field magnitude and direction values for a set of preselected spaced-apart points within the magnetic coil on the basis of the geometry of the magnetic coil and characteristics of the superconductor material;

e) determining a distribution of critical current values for each of the preselected spaced-apart points within the magnetic coil based on the distribution of magnetic field magnitude and direction values determined in step d) and the critical current characteristic data determined in step c);

f) determining contributions toward the center magnetic field of the coil from each of the sections by determining a magnetic field value associated with each of the sections on the basis of the geometry of each section and characteristics of the superconductor material of the section;

g) determining a critical current value for the coil and for each section positioned along the axis of the coil based on the distribution of critical current values for the set of preselected spaced-apart points within the magnetic coil determined in step e); and h) changing the critical current value of at least one section of the coil to provide the critical current values for each section greater than a predetermined value on the basis of the contributions toward the center magnetic field determined in step f) and the critical current values for each section determined in step g).

2. The method of claim 1 further comprising the step of repeating steps d) through h) until the critical current values of each of the sections are within a desired range of each other.

3. The method of claim 1 wherein step h) of changing the critical current value of at least one section of the coil further comprises the step of changing the cross-sectional area of the at least one section of the coil.

4. The method of claim 1 wherein step h) of changing the critical current value of at least one section of the coil further comprises the step of changing the type of superconductor of the at least one section of the coil.

5. The method of claim 1 wherein step g) of determining a critical current value for each section positioned along the axis of the coil includes the step of determining an average critical current value for each section, the average critical current value based on values of critical current associated with corresponding ones of the preselected spaced-apart points extending axially away from the section.

6. The method of claim 1 wherein step g) of determining a critical current value for each section positioned along the axis of the coil includes the step of determining an average critical current value for each section, the average critical current value based on values of critical current associated with corresponding ones of the preselected spaced-apart points extending radially away from the section.

7. The method of claim 1 wherein step h) of changing the critical current value of at least one section of the coil further comprises the step of increasing the cross section of the superconductor material associated with sections of the superconductor that are away from the center of the coil.

8. The method of claim 1 wherein step c) of determining critical current characteristic data for each of the sections of the coil further comprises the steps of:

measuring the critical current of the superconductor material associated with each section at a number of different magnitudes and directions of an applied background magnetic field; and extrapolating critical current data for unmeasured magnitudes and angles of a background magnetic field.

9. The method of claim 1 wherein, prior to said step of positioning the sections along the axis, the method further comprises the step of providing each section in the form of bulk semiconductor material.

10. The method of claim 9 wherein the step of providing each section in the form of bulk semiconductor material comprises providing superconducting filaments in tape form.

* * * * *